United States Patent [19]

Byers

[11] Patent Number: 5,056,561

[45] Date of Patent: Oct. 15, 1991

[54] REMOTE CONTROLLED, INDIVIDUALLY PRESSURE COMPENSATED VALVE

[76] Inventor: James O. Byers, 5388 Orchard Hill, Kalamazoo, Mich. 49002

[21] Appl. No.: 477,334

[22] Filed: Feb. 8, 1990

[51] Int. Cl.[5] ..... F15B 13/044; F15B 13/06

[52] U.S. Cl. ..... 137/625.64; 91/433; 137/596.13; 137/625.6; 137/625.61

[58] Field of Search ..... 91/433; 137/596.13, 137/625.6, 625.61, 625.64

[56] References Cited

U.S. PATENT DOCUMENTS

| | | | |
|---|---|---|---|
| 2,909,195 | 10/1959 | Keyt | 91/433 X |
| 3,434,390 | 3/1969 | Weiss | 137/625.61 X |
| 3,763,746 | 10/1973 | Walters | 91/433 |
| 3,854,382 | 12/1974 | Walters et al. | 91/433 |
| 3,874,269 | 4/1975 | Walters | 91/433 |
| 3,878,765 | 4/1975 | Walters et al. | 91/433 |
| 3,893,471 | 7/1975 | Byers, Jr. . | |
| 3,943,957 | 3/1976 | Hayner | 137/625.64 X |
| 4,031,813 | 6/1977 | Walters et al. . | |
| 4,049,232 | 9/1977 | Byers, Jr. . | |
| 4,205,592 | 6/1980 | Haussler | 91/433 X |
| 4,362,084 | 12/1982 | Walters | 137/625.64 X |
| 4,411,289 | 10/1983 | Walters | 137/486 |
| 4,598,626 | 7/1986 | Walters et al. | 137/625.64 X |

FOREIGN PATENT DOCUMENTS

| | | | |
|---|---|---|---|
| 0116739 | 8/1984 | European Pat. Off. | 137/625.64 |
| 2754878 | 6/1979 | Fed. Rep. of Germany | 137/625.64 |

*Primary Examiner*—Gerald A. Michalsky

*Attorney, Agent, or Firm*—Price, Heneveld, Cooper, DeWitt & Litton

[57] ABSTRACT

A remote controlled individually pressure compensated hydraulic valve assembly includes a directional valve having an inlet, a load holding check valve, an outlet passage, at least one outlet or cylinder port, and a tank or drain port. The valve defines a bore within which a spool is moveably disposed. A control device includes hydraulic remote actuators or an electro magnetic device to generate a command signal. The control device compares the command signal to an output of a flow measuring device to position the valve spool so that a desired flow rate at the valve cylinder command signal. The load holding check valve is used as the flow measuring device. The check valve includes a valve element and a spring selected so that the differential pressure across the valve element is proportional to flow rate.

39 Claims, 14 Drawing Sheets

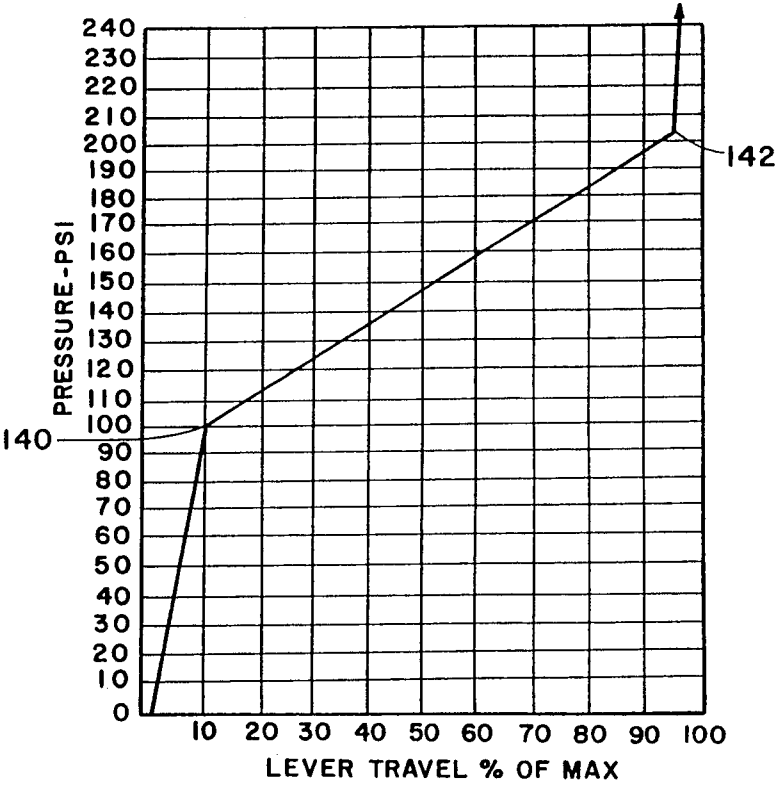
FIG 5
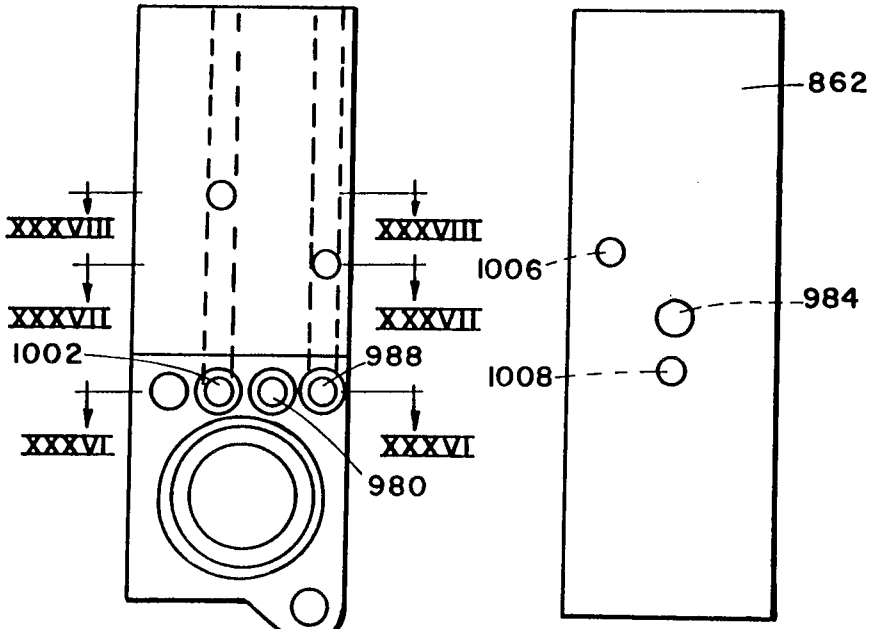
FIG 34
FIG 33
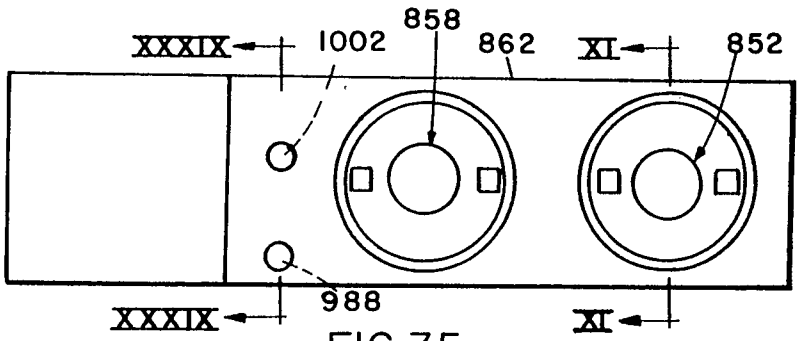
FIG 35

312
426
104"
456

102"
96"
438
226
426
104"
310
280

222
426
224
456
456

XVI
XV
XIV
XIII
XII
96"
102"
104"
104"
102"
96"
XVI
XV
XIV
XIII
XII 438
104"
96"
102"

422
420
222
456
426
454
448
450
224
Pco 318
342
320
456
290
102"
344

REMOTE CONTROLLED, INDIVIDUALLY PRESSURE COMPENSATED VALVE

BACKGROUND OF THE INVENTION

The present invention relates to controls for hydraulic actuators and more particularly to hydraulic valves and controls for such valves.

Hydraulic actuators are used in many mobile applications such as aerial platforms, earth moving equipment, cranes, and the like. The actuators are work cylinders or motors that are controlled by suitable hydraulic controllers. In some instances, the controllers are positioned for ease of plumbing and actuated from a remote location such as an operator cab. The remote actuation may be accomplished hydraulically or electrically.

In typical remote controlled valve systems a plurality of three- or four-way, hydraulic directional control valves are grouped in a valve bank. The bank is defined by a valve body having a plurality of bores for receiving individual valve spools. The valve body defines an inlet pressure port and a tank port. The inlet port is connected to a source of hydraulic fluid under pressure. In four-way, open center valve systems, each valve includes a pair of cylinder ports or outlets and a pair of tank or drain outlets. When a valve spool is in a neutral position, fluid flows through the valve directly from the inlet port to the tank port. A load holding check valve is disposed between an inlet port passage and an outlet pressure passage which is connectable to the cylinder ports by the valve spool. As the valve spool is displaced in response to an input signal, flow is restricted raising input pressure and causing the load control check valve to move to an open position. Fluid will flow from the inlet passage to the outlet pressure passage and around the spool to one of the cylinder ports. The valve spool opens one of the cylinder ports to input fluid flow while opening the other cylinder port to a tank, drain or return passage.

In many applications, electric or hydraulic remote control is provided for the hydraulic actuator control valves. In many such applications, a flow rate from the control valve which is approximately proportional to an input signal such as a control handle position would be desirable. Flow rate through a control valve at a given spool position will, also, vary with changes in input and/or output pressures. The flow rate through an hydraulic control valve is generally proportional to the square root of the differential pressure across the valve spool. Pressure changes can occur as the result of loads on the working cylinder and due to opening of additional valves in a valve bank. In order to maintain a predetermined or fixed flow rate for a given input or control signal, the valve spool must be shifted to compensate for such variances in pressure. Lack of compensation results in erratic or jerky actuator and hence equipment operation.

Individually pressure compensated control valves have been proposed. An example of one such valve may be found in U.S. Pat. No. 4,049,232 entitled PRESSURE COMPENSATING FLUID CONTROL VALVE and issued on Sept. 2, 1977 to the present inventor. The control valve disclosed therein includes a valve body having a valve spool mounted for movement from a neutral or open center position wherein fluid flows through the valve body to an operating position wherein the flow of fluid through the valve is restricted to direct inlet fluid through a flow control orifice to a pressure passage within the valve body. The pressure passage is connected to one of a pair of cylinder passages or ports. The other cylinder passage is connected to a tank passage. Pressure compensation to maintain a predetermined flow rate through the control orifice is achieved by imposing inlet and pressure passage pressure selectively to each end of the valve spool so that the spool responds to the pressure differential across the control orifice. The flow rate between the inlet passage network and the pressure passage is controlled by either a low force proportional solenoid valve assembly or a mechanically actuated assembly Another example of an hydraulic system may be found in U.S. Pat. No. 4,031,813 entitled HYDRAULIC ACTUATOR CONTROLS and issued on June 28, 1977 to Walters et al. A device for controlling an hydraulic actuator is disclosed which includes two servo loops having a fluid pressure operated main valve and an electrically operated pilot valve for controlling the main valve. One of the servo loops provides flow control and the other servo loop provides force control.

Presently available remote controlled directional valve systems suffer from various problems. Most systems have unpredictable metering ranges. Predictability can be achieved with some systems only by closely maintaining tolerances on the housing, metering lands, valve spools, springs and other components. In addition, hysteresis due to friction on the valve spools will cause a wide dead band in the remote control where movement of an input lever does not change flow rate. The available metering range will also decrease as system pressure increases. Present individually pressure compensated systems are also complex, difficult to manufacture and assemble and, hence, relatively costly. A need exists, therefore, for hydraulic or electric remote controlled valves for hydraulic actuators whereby the aforementioned problems are overcome.

SUMMARY OF THE INVENTION

In accordance with the present invention, the aforementioned need is essentially fulfilled. A valve in accordance with the present invention uses a control device which compares an input force or command pressure signal to a feed back differential pressure signal to position a directional control valve spool until the desired or commanded flow rate is achieved. Essentially, the control device includes a body defining a bore within which a servo spool is disposed. Provision is made for directing a differential feedback pressure signal from the directional valve to the control device. The feedback pressure signal is compared to a command signal. The control positions the spool of the directional valve until the differential pressure equals or balances the command signal. As a result, a given or predetermined command signal will produce a predictable flow rate from the control valve.

In narrower aspects of the invention, the command signal may be a pressure signal generated by hydraulic remote controls or by an electro-hydraulic controller. In a further embodiment, the command signal is generated by a proportional solenoid. Also, the control concept of the present invention may be used in two stage or single stage control valve systems. Each embodiment of the present invention results in an individually pressure compensated control valve. Operation of additional valves in a valve bank and resulting pressure fluctuations are compensated for and flow rate is controlled. The embodiments of the present invention are relatively easily manufactured and assembled. The control structure is readily employed with existing directional valves. Only minor modification is necessary. Flow rates at the control valve cylinder ports are independent of pressure at such port or pressures required by other valves of a bank of valves.

BRIEF DESCRIPTION OF THE DRAWINGS

FIG. 5 is a graph of control pressure versus lever position for a typical hydraulic remote control system;

FIG. 33 is a left, end elevational view of the control of FIG. 32;

FIG. 34 is a right, elevational view of the control of FIG. 32;

FIG. 35 is a top, plan view thereof;

DETAILED DESCRIPTION OF THE PREFERRED EMBODIMENTS

Figure 1:
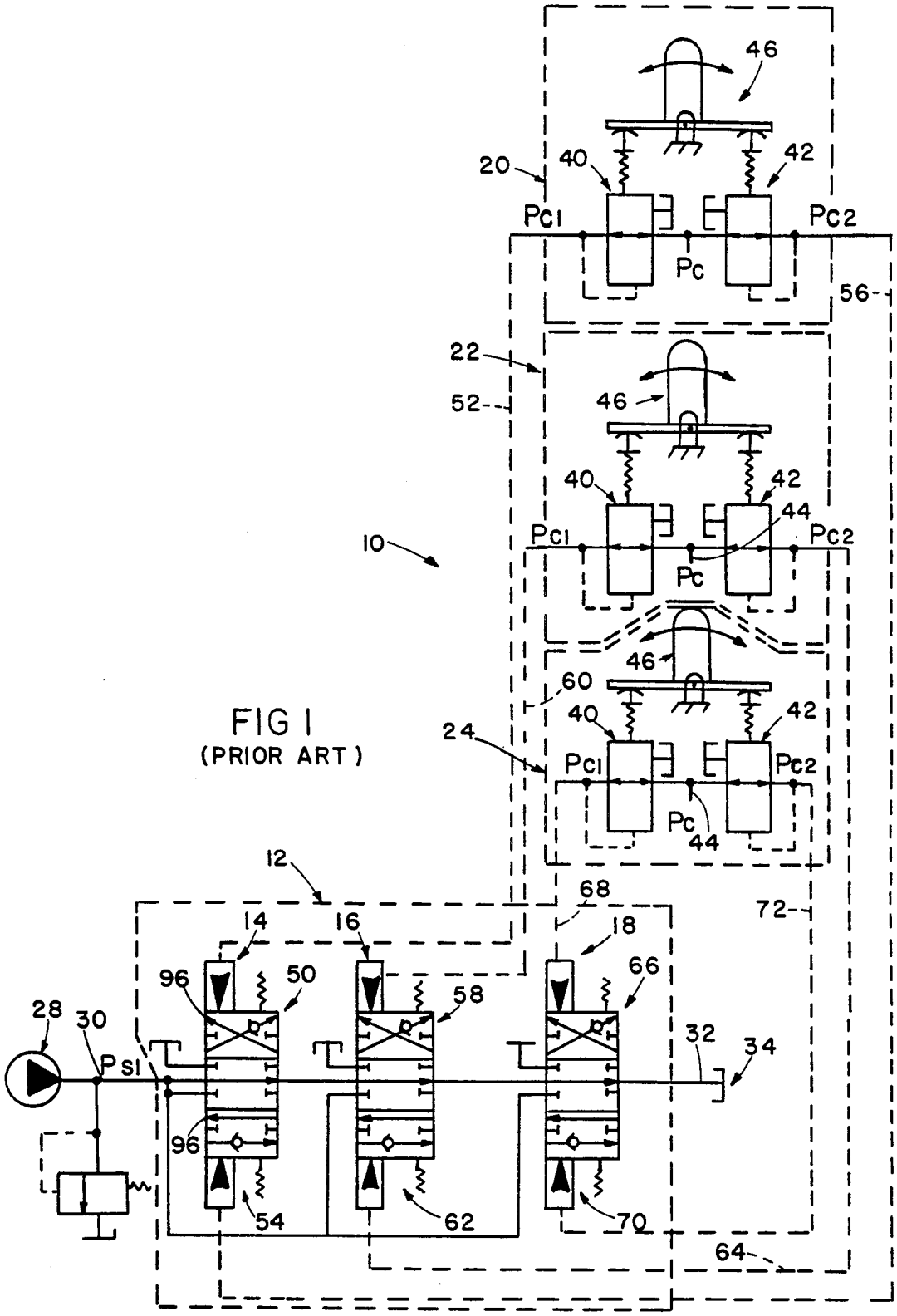
FIG 1 (PRIOR ART)
FIG. 1 is a schematic of a conventional mobile hydraulic four-way valve bank with hydraulic remote control.
Figure 2:
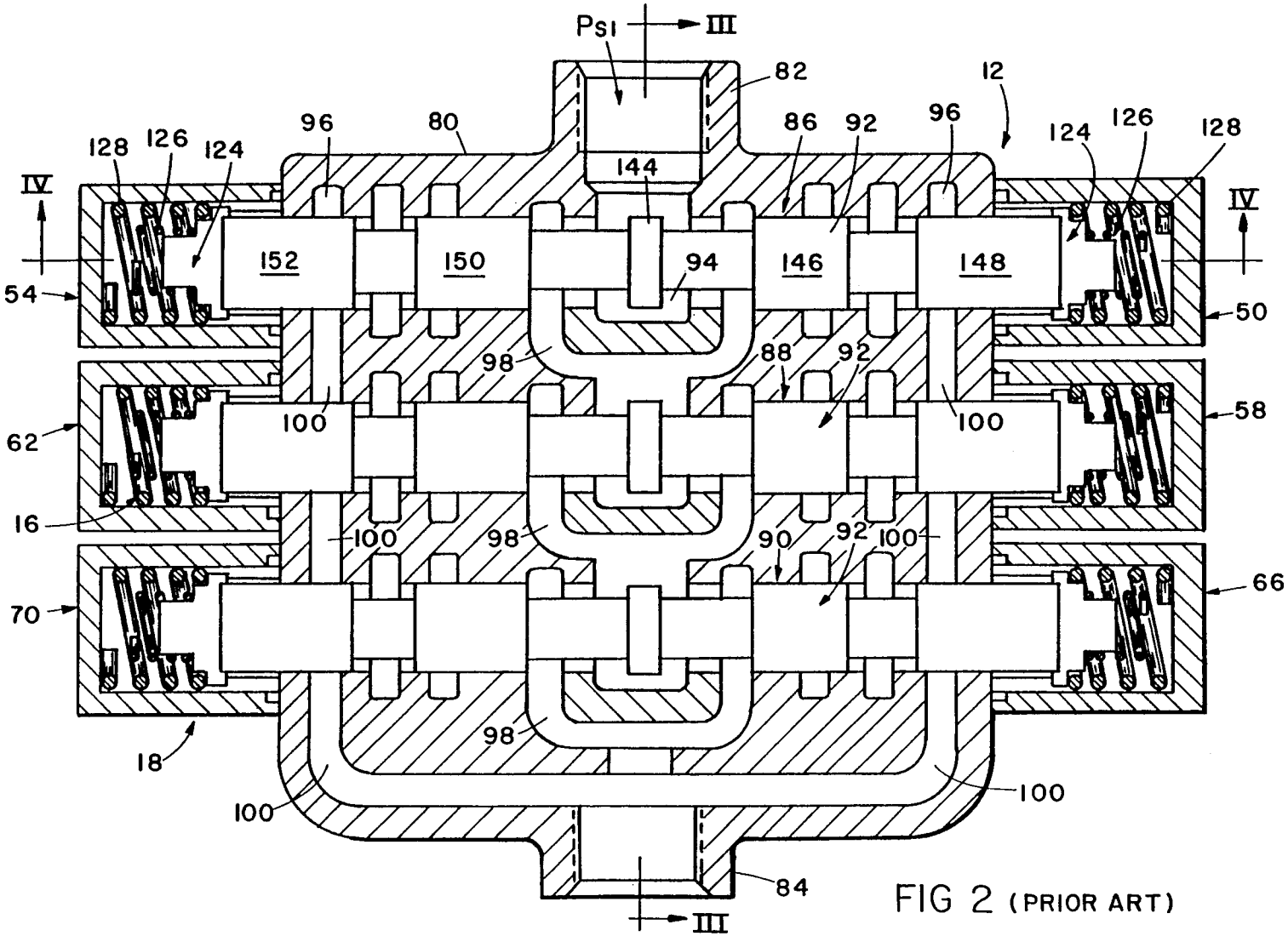
FIG 2 (PRIOR ART)
FIG. 2 is a cross sectional view of a valve bank including three hydraulic control or directional valves.
Figure 3:
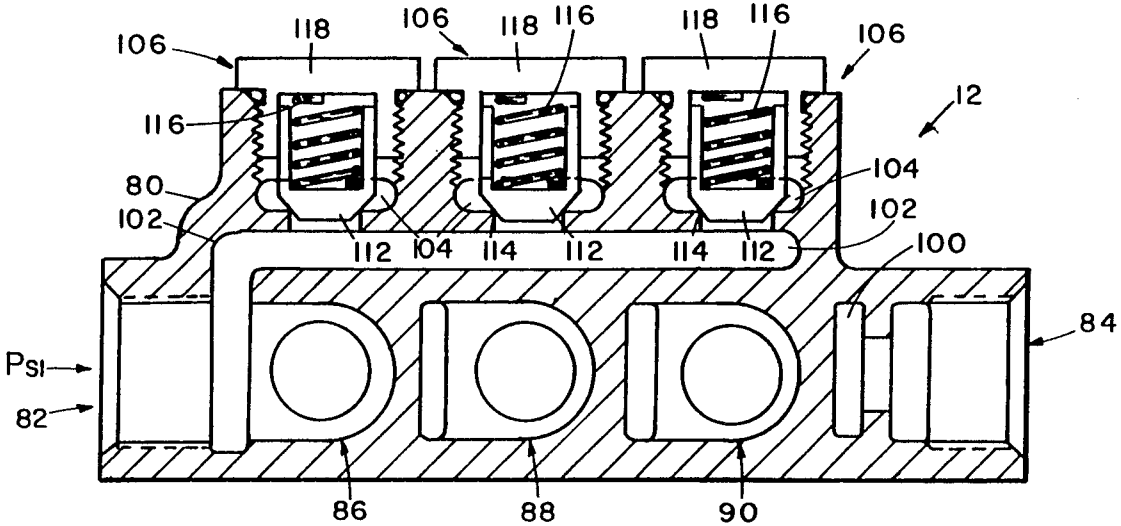
FIG 3 (PRIOR ART)
FIG. 3 is a cross sectional view taken generally along line III—III of FIG. 2.
Figure 4:
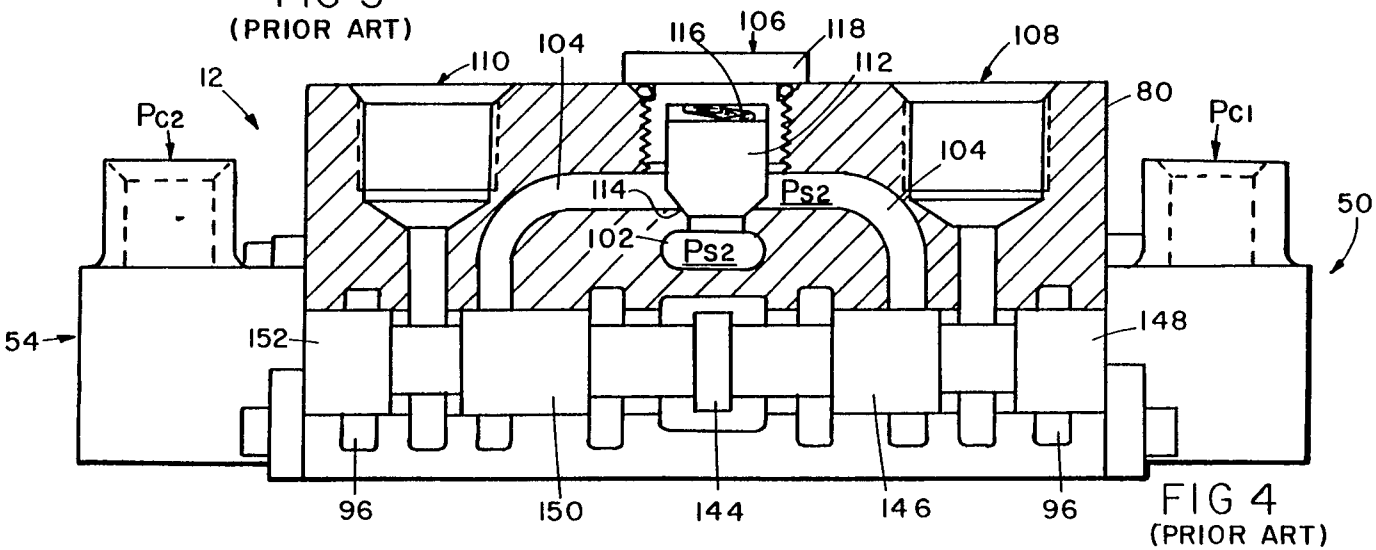
FIG 4 (PRIOR ART)
FIG. 4 is a cross sectional view taken generally along line IV—IV of FIG. 2.

A conventional mobile hydraulic four-way valve bank incorporating hydraulic remote control actuators is schematically illustrated in FIG. 1 and generally designated 10. A clearer understanding of the present invention will result from a description of conventional control valve systems. The schematic shows a system capable of operating three piston-cylinder actuators. Such actuators may raise a boom, control a blade and the like. The system includes a bank 12 having three directional hydraulic control valves 14, 16 and 18. Each directional valve is connected to a suitable remote hydraulic controller or actuator subassembly 20, 22 and 24. Each four-way valve 14, 16 and 18 is of the open center type as shown in FIGS. 2, 3 and 4. The valves are connected to a suitable hydraulic power source or pump 28 which supplies hydraulic fluid at pressure $P_{s1}$ to the bank through hydraulic line 30. As explained in more detail below, fluid passes through the valve bank to a discharge or drain line 32 and to a tank or reservoir 34.

Each hydraulic controller 20, 22 and 24 includes a pair of conventional regulators 40, 42. The regulators are connected to a source of control fluid at a pressure $P_c$ by a line 44. The regulators are controlled by a lever subassembly 46. Regulator 40 of subassembly 20 is connected to an end cap 50 at one end of directional valve 14 by a line 52. The output from regulator 42 is connected to an end cap 54 of valve 14 by a line 56. The output from regulator 40 of subassembly 22 is connected to an end cap 58 of valve 16 by a line 60. The output from regulator 42 is connected to the opposite end cap 62 of valve 16 by line 64. Finally, the output of regulator 40 of subassembly 24 is connected to one end cap 66 of valve 16 by line 68 and the output of regulator 42 of subassembly 24 is connected to end cap 70 by a line 72. Each regulator 40 is operable to produce a control pressure or command signal $P_{c1}$ and each regulator 42 is operable to produce a control pressure or command signal $P_{c2}$.

Bank 12 includes a body 80 defining an inlet port 82 and an outlet port 84 (FIGS. 2, 3 and 4). Port 82 is connected to line 30 and hence to a source of hydraulic fluid at pressure $P_{s1}$. Outlet port 84 is connected to the drain, tank or reservoir. Body 80 defines a series of three valve bores 86, 88 and 90. Positioned within each valve bore is a spool valve 92. Bores 86, 88 and 90 each define a plurality of recesses including a central or neutral recess 94 and tank or drain recess 96. Center recesses 94 are connected together in series by passageways 98. Tank or drain recesses 96 are connected by passageways 100.

Each directional valve includes an inlet passage 102 connected to a respective center or neutral recess 94 (FIGS. 3, 4). An outlet passage 104 is defined by the valve body at each valve. Passage 102 communicates with passage 104 through a load holding check valve assembly 106. Check valve 106 includes a valve element 112 biased to a closed position against a valve seat 114 by a spring 116. The check valve is retained by a threaded cap 118. The valve body at each individual valve further defines a first cylinder port 108 and a second cylinder port 110. Port 108 is connected to one end of an actuator. Port 110 is connected to the opposite end of the actuator.

The hydraulic end caps 50, 54, 58, 62, 66 and 70 are identical. Each end cap includes a piston element 124 engaging an end of valve spool 92 (FIG. 2). Springs 126, 28 engage the pistons 124. The springs position and bias spool 92 to a neutral or centered position The remote pressure regulators 40, 42 of each remote controller are conventional in nature. When the control level 46 operated by the user is in the neutral position, the output control pressures $P_{c1}$ and $P_{c2}$ are near zero. As the lever 46 is rotated to the right when viewed in FIG. 1, the output pressure $P_{c1}$ will remain near zero and the output pressure $P_{c2}$ will increase. Typically, as the lever is moved through the first 5% to 10% of rotation, the control pressure $P_{c1}$ and/or $P_{c2}$ will increase as a step function to approximately one-half of the maximum regulated pressures. This is illustrated in the graph of FIG. 5. As the lever is moved from the step pressure increase or set point designated 140 in FIG. 5, the output pressure $P_{c1}$ or $P_{c2}$ will increase in an approximately linear fashion until, at maximum rotation of the lever, the control pressure will be at its maximum point 142. As schematically shown in FIG. 1, the levers 46 are arranged so that one of the control pressures $P_{c1}$ or $P_{c2}$ will remain at near zero as the other pressure increases from a minimum to a maximum.

In a conventional fashion, therefore, as lever 46 of controller 20 is rotated to generate a control output pressure $P_{c1}$ at hydraulic remote control end cap 50, pressure within the end cap increases shifting spool valve 92 to the left when viewed in FIGS. 2 and 4. When moved, the center land restricts flow within recess 94 to outlet 84 increasing the pressure $P_{s1}$ within inlet passage 102. When pressure $P_{s1}$ is sufficient to overcome spring force 116 check valve 112 will lift from its seat 114. Fluid will, therefore, enter outlet passage 104. A pressure drop occurs across seat 114 when fluid is flowing and the pressure in passage 104 will be $P_{s2}$. Lands 146, 148 are positioned so that cylinder outlet port 108 communicates with outlet passage 104. Lands 150, 152 are positioned so that cylinder port 110 will communicate with tank recess 96. The flow rate Q through the conventional valve to cylinder port 108 is proportional to the square root of the differential pressure $(P_{s1}-P_{s2})$ between passage 102 and passage 104, that is, $Q=CA(P_{s1}-P_{s2})^{\frac{1}{2}}$ wherein A is the area of the valve seat orifice and C is a constant. In conventional valves, the spring 116 has a very low spring rate. The check valve opens fully at very low pressure drops.

As the pressure varies in the inlet passage or the outlet passage the flow rate will vary from the desired flow rate set by the controller lever 46. Reverse flow from cylinder port 108 to inlet passage 102 is prevented by the load holding check valve 106 which will close to prevent such reverse flow. In addition, should one valve be open in the bank and another lever of one of the remaining controllers be rotated, there will be a change in the inlet passage pressure on the first valve to be opened. The pressure $P_{s1}$ within passage 102 (FIG. 3) is set by the valve requiring the greatest flow. This will result in a change in the flow rate from that valve to the cylinder which it is controlling.

These problems coupled with lack of tolerances in the manufacturing process and valve output hysteresis result in erratic working cylinder operation. In accordance with embodiments of the present invention, the hydraulic remote control end caps shown in the conventional system of FIGS. 2–4 are eliminated. In addition, check valve 112 is constructed or designed so that the flow rate Q across the valve is substantially linear to the differential pressure $(P_{s1}-P_{s2})$ and not the square root thereof. To achieve flow rates directly proportional to differential pressure, the spring 116 must be properly designed. The spring rate is selected for the given valve area so that a flow rate $Q_3$ at the check valve 112 position that causes the valve element to lift 0.10 inches is 10 (ten) times the flow rate $Q_1$ when the check valve element is lifted 0.010 inches and two (2) times the flow rate $Q_2$ when the check valve element is lifted 0.05 inches. The spring force is inversely proportional to the check valve position. As a result, the spring force and the differential pressure $(P_{s1}-P_{s2})$ will be approximately proportional to the flow rate Q across the check valve or $Q=CA(P_{s1}-P_{s2})$. In the present invention, a single measuring device or control is used which measures flow rate by measuring or sensing the differential pressure $(P_{s1}-P_{s2})$ to either cylinder port 108, 110 that is across check valve 112. The differential pressure is fed back to a summing device causing movement of the directional valve spool as required to maintain the differential pressure equal to or balanced with a command force or signal. If the differential pressure does not match the command force, the summing device will cause the directional valve spool to move until a balance is achieved The assemblies in accordance with the present invention provide flow rates which are substantially the same for a given input signal set by the degree of rotation of lever travel, for example. In addition, flow rates from each of the directional or control valves in a valve bank are pressure compensated. Opening of additional valves results in repositioning of the valve spools to maintain the desired flow rates. Compensation is made for pressure changes. The basic concepts of the present invention are usable in hydraulically remote control valves, electro-hydraulic remote control valves, solenoid controlled valves and electro-hydraulic remote control valves which use an electromagnetic force as a command signal instead of a fluid pressure signal. In addition, the concepts may be used in two stage or single stage applications.

INDIVIDUALLY PRESSURE COMPENSATED HYDRAULIC REMOTE CONTROLLED VALVE

Figure 7:
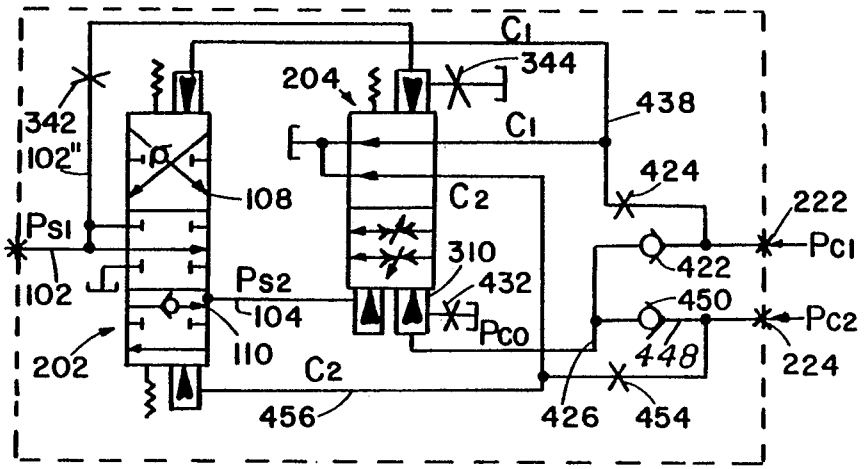
FIG. 7 is a schematic of an hydraulic directional valve and control in accordance with the present invention.
Figure 6:
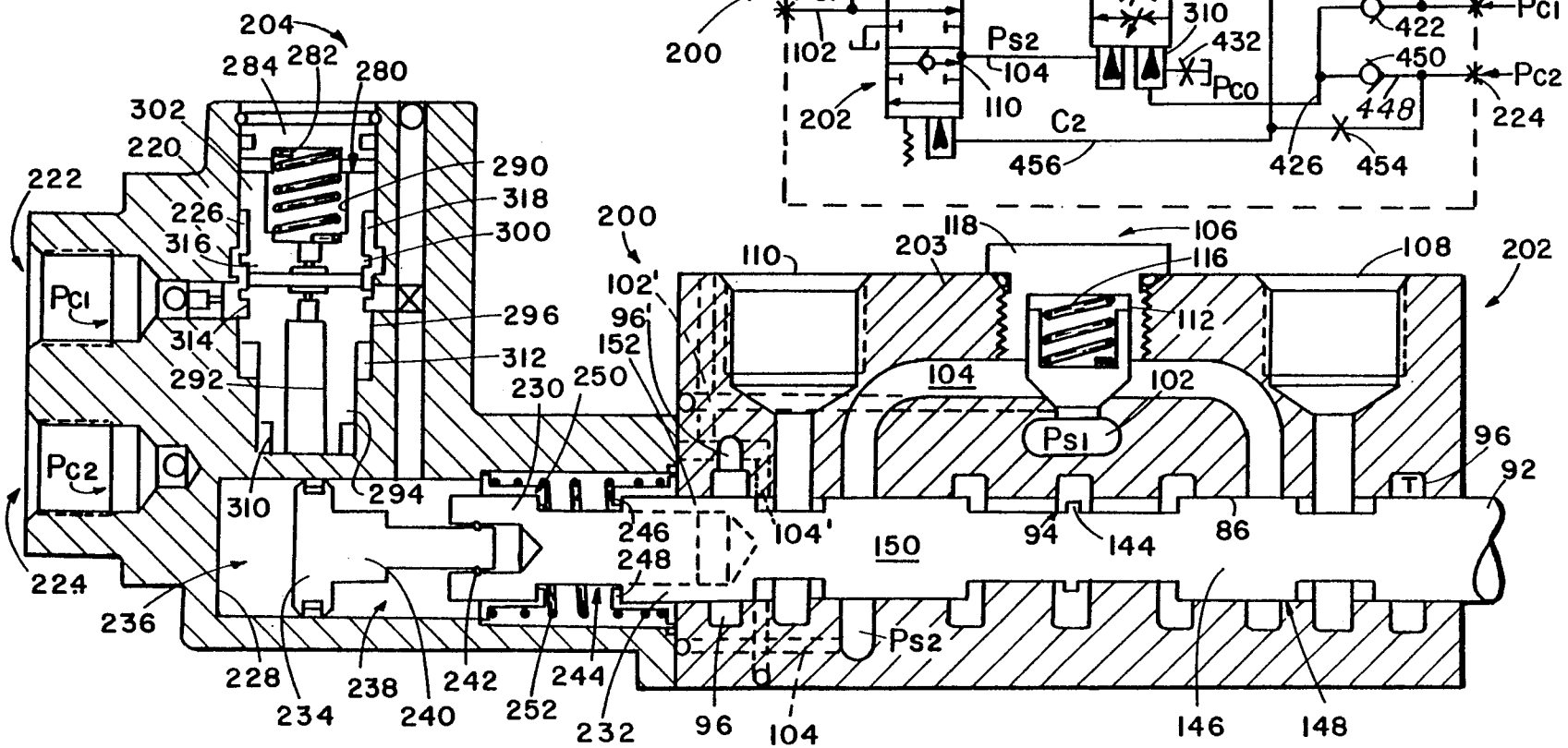
FIG. 6 is an elevational view, in cross section, of an individually pressure compensated valve in accordance with the present invention.

A pressure compensated mobile hydraulic control valve assembly 200 in accordance with the present invention is shown in FIG. 6 and schematically illustrated in FIG. 7. Assembly 200 includes a directional valve assembly 202 and a pressure compensating or feedback control 204. Only a single directional valve is illustrated in FIGS. 6 and 7. Valve 202 may be one of a bank of valves. Conventional items or portions of the valve will be designated with the same numerals used to designate like portions in FIGS. 1–4. Valve 202 includes a body 203 which defines bore 86. Bore 86 receives shiftable valve spool 92. Body 203 includes inlet and outlet ports (not shown). The inlet port is connected to center recess 94 and inlet passage 102. Inlet passage 102 is connected to outlet or pressure passage 104 through load holding check valve subassembly 106. Check valve subassembly 106 includes check valve element 112 slidable within cap 118 and biased to the closed position by spring 116 having a spring rate as discussed above Valve 200 includes first cylinder port 108 and second cylinder port 110. Spool 92 includes lands 146, 148, 150, 152 and center land 144. Control valve spool 92 moves within the valve body bore 86 to provide directional control of the fluid moving through the valve. Valve body 203 of FIG. 6 has been modified slightly from the body illustrated in FIGS. 2–4. The body is drilled to form an extension 102' of input passage 102 which is ported to control 204. Pressure passage 104 is ported through a drilled passage 104' to control 204. Finally the tank passage or drain recess is similarly drilled and ported to control 204 along passage portion 96'.

Assembly 204 includes a body 220. Body 220 defines a first command pressure or signal input port 222, a second command pressure or signal input port 224, a servo bore 226 and a pilot bore 228. A fastener 230 is threaded to an end 232 of spool 92. A pilot piston 234 is slidably disposed within bore 228 dividing the bore into cylinder chambers 236, 238. Piston 234 includes a rod portion 240 connected to a head 242 of fastener 230. Shifting of piston 234 will, therefore, position spool 92 within the valve body 203.

Piston 234 and spool 92 are biased to a centered or neutral position by a spring assembly 244. Spring assembly 244 includes a first generally cup shaped retainer 246. Retainer 246 defines a center bore 248. Retainer 246 is positioned on end 232 of spool 92 and in engagement with a side of the valve body 203. A second retainer 250 opposes retainer 246 and engages head 242 of fastener 230. A coil spring 252 extends between and engages retainers 246, 250. Due to the positioning of the retainers in the spring, the spring resists movement of spool 92 to the right and to the left thereby biasing the spool towards its centered or neutral position.

Control assembly 204 further includes a servo spool 280 disposed within bore 226. Spool 280 is biased to an initial position by a set point spring 282. Spring 282 is positioned between spool 280 and a cap 284 which closes bore 226. Control 204 uses the pressure differential across check valve 106 as a measurement of flow rate to a cylinder outlet port. The pressure differential is controlled to achieve a fixed flow rate for a given input signal $P_{c1}$ or $P_{c2}$. The control compensates for variations in the pressures $P_{s1}$ and $P_{s2}$ to shift valve spool 92 to maintain the pressure differential and hence the desired flow rate for a particular input signal.

Figure 19:
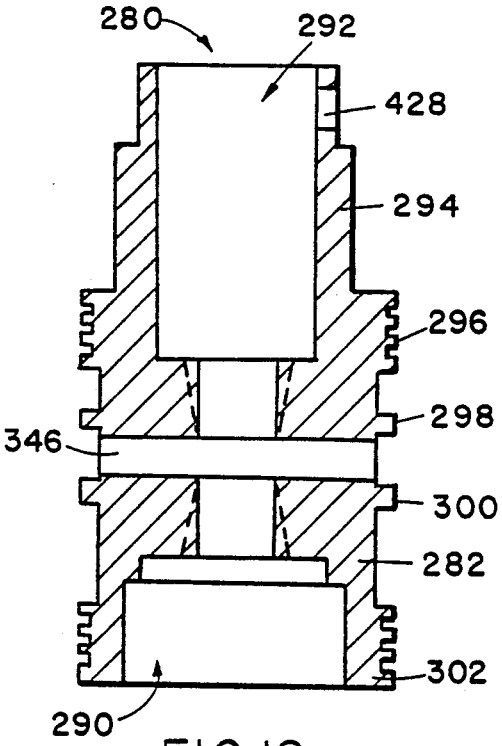
FIG. 19 is a cross sectional view of a servo spool incorporated in the control of FIG. 8.

Servo spool 280 includes an upper bore 290 opening through an upper end thereof and a lower bore 292 opening through a lower end thereof (FIGS. 6 and 19). Spool 280 further includes a first land 294, a second land 296, spaced lands 298, 300 and a top land 302. The lands separate grooves in the spool. Spool 280 in conjunction with bore 286 defines a command pressure chamber 310, a pressure passage chamber 312, a first control chamber or recess 314, a drain chamber or recess 316, a second control chamber or recess 318 and an inlet passage chamber 320. The body 220 defines a passage network which interconnects the input ports and the chambers in a fashion which results in proper positioning of piston 234 within valve bore 228.

Figure 8:
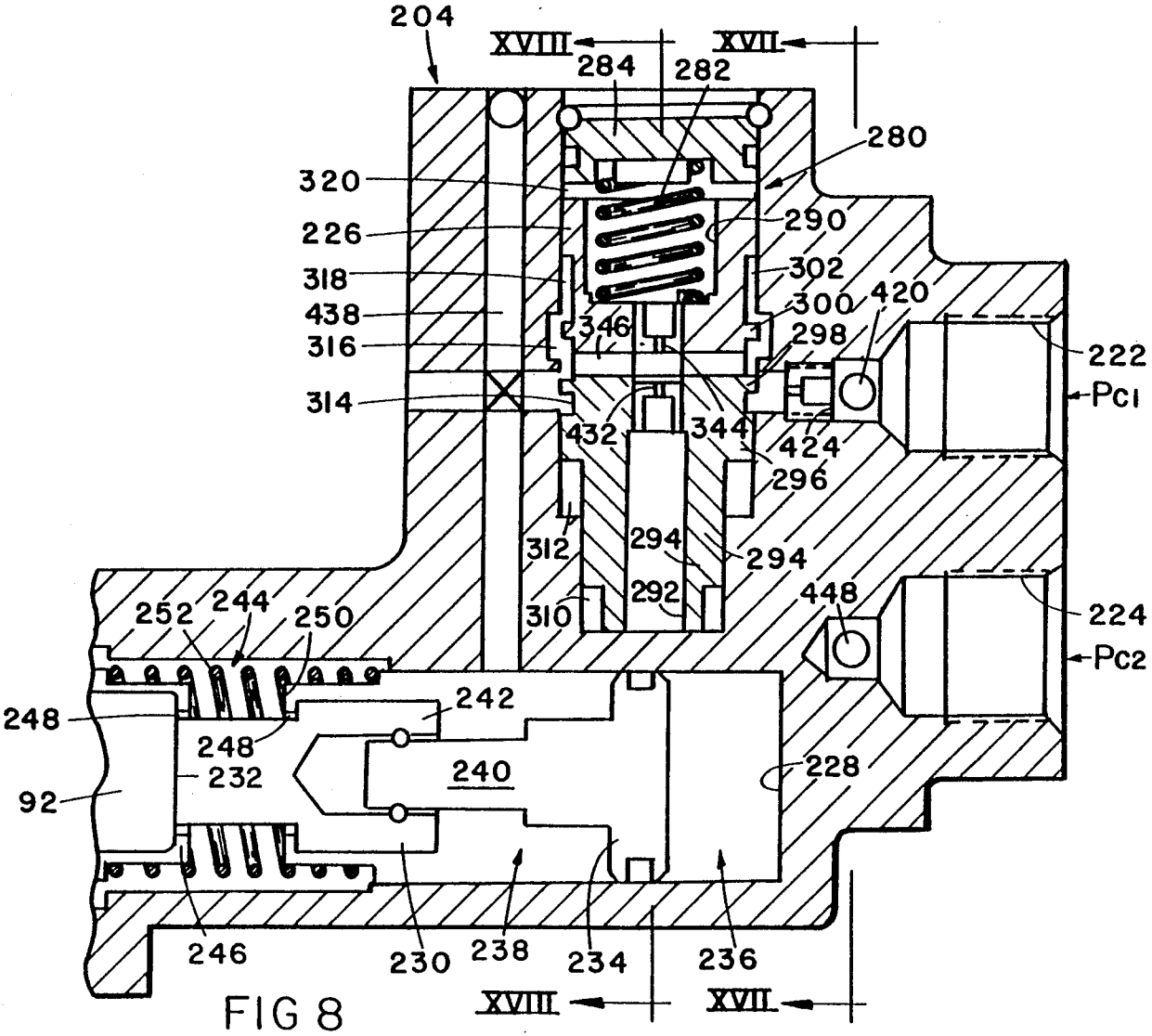
FIG. 8 is a side, elevational view in partial section of a control in accordance with the present invention.
Figures 9, 10, 11, 12, 13, 15, 16, 17:
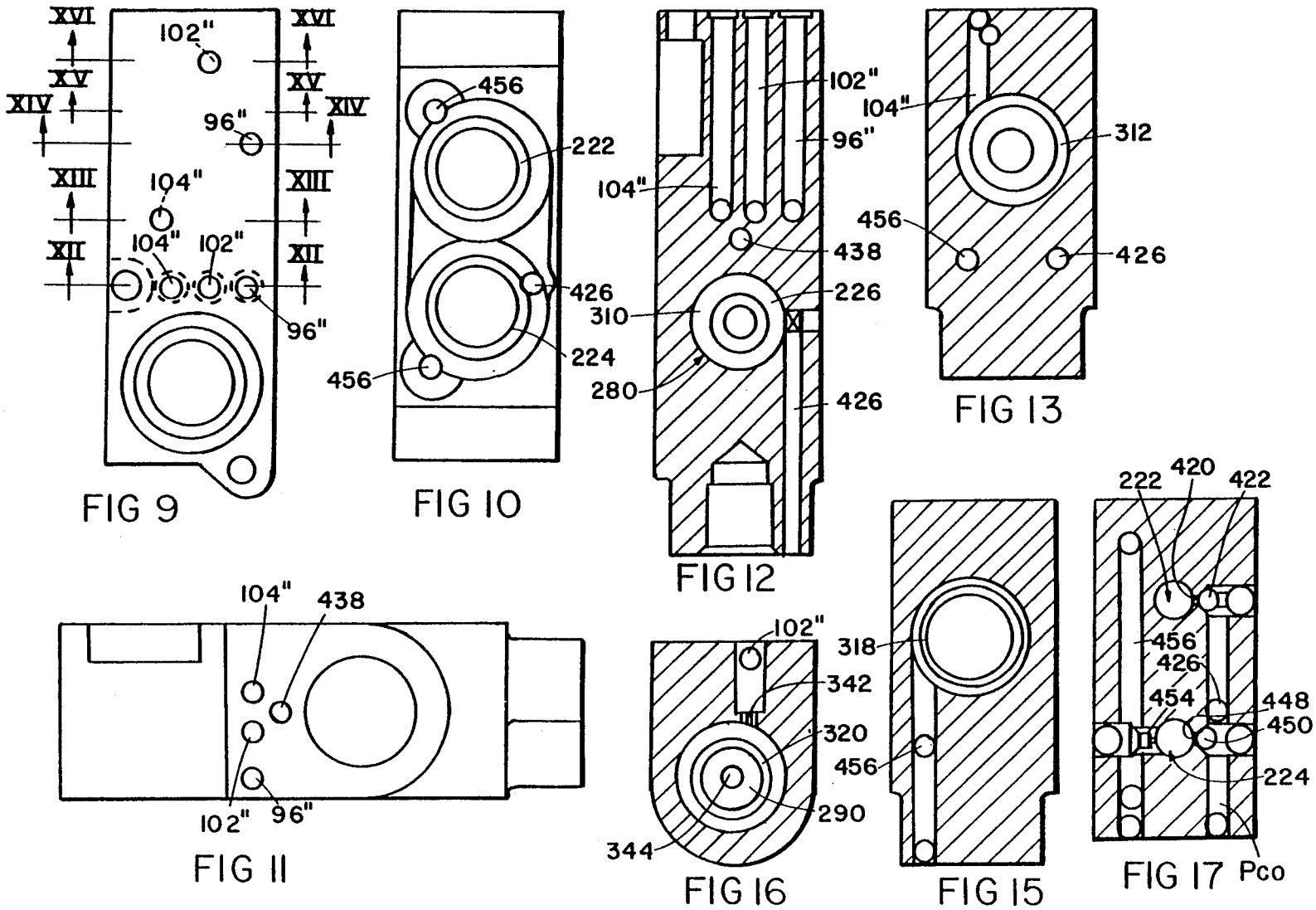
FIG. 9 is a left end elevational view of the control of FIG. 8.
FIG. 10 is right, elevational view thereof.
FIG. 11 is a top, plan view thereof.
FIG. 12 is a cross sectional view taken generally along line XII—XII of FIG. 9.
FIG. 13 is a cross sectional view taken generally along line XIII—XIII of FIG. 9.
FIG. 15 is a cross sectional view taken generally along line XV—XV of FIG. 9.
FIG. 16 is a cross sectional view taken generally along line XVI—XVI of FIG. 9.
FIG. 17 is a cross sectional view taken generally along line XVII—XVII of FIG. 8.

As seen in FIGS. 8–17 and schematically illustrated in FIG. 7, body 220 defines a passage 102" which connects with passage 102 of the directional valve body 203. Passage 102" enters body 220 horizontally and then moves vertically (FIGS. 11, 12). Passage 102" conveys fluid at pressure $P_{s1}$ to an orifice 342 (FIGS. 7 and 16). The fluid after passing through orifice 342 enters chamber 320. The fluid at pressure $P_{s1}$ passes through chamber 320 and an orifice 344 at the base of bore 290 in servo 280 (FIG. 8). Servo 280 includes a transverse passage 346, passage 346 opens between cylindrical lands 298, 380. The fluid entering chamber 320, therefore, passes through orifice 344, passage 346 to drain or tank recess 316. Orifices 342, 344 are matched so that the pressure within chamber 320 is equal to $P_{s1}/2$.

Figure 14:
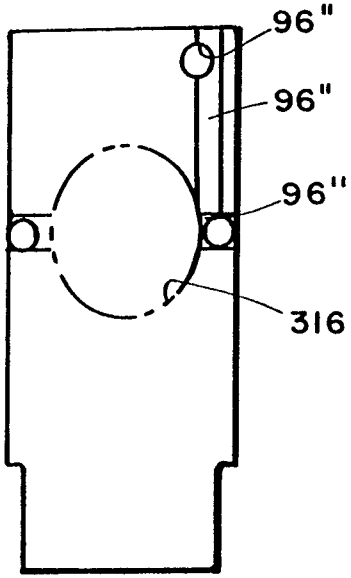
FIG. 14 is a cross sectional view taken generally along line XIV—XIV of FIG. 9.
Figure 18:
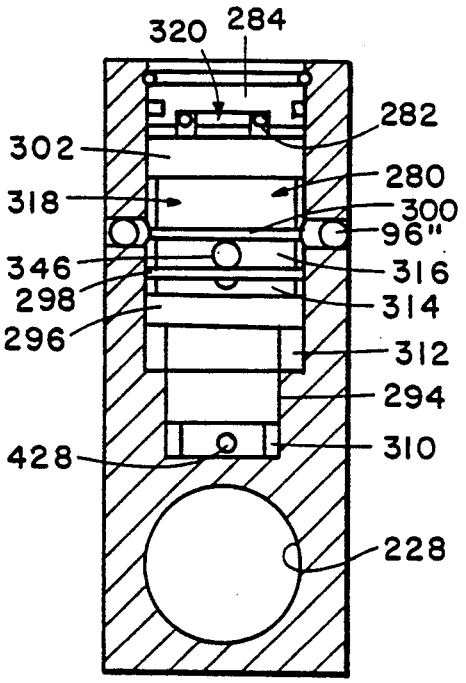
FIG. 18 is a cross sectional view taken generally along line XVIII—XVIII of FIG. 8.

Body 220 defines a passage 96" (FIG. 12) which connects to drain recess or chamber 316 (FIGS. 14 and 18). Passage 96" connects with passage 96' and valve 202 to drain fluid to the tank.

Fluid at pressure $P_{s2}$ in pressure passage 104 is directed through passage extension 104' to a passage 104" in the controller body 220. Fluid at pressure $P_{s2}$ passes through passage 104" to pressure passage chamber 312 (FIGS. 11, 12, 13, and 18). The effective area of the spool 280 that is exposed to pressure $P_{s2}$ is equal to one-half the area exposed to the pressure $P_{s1}/2$ As a result, equal pressures $P_{s1}$ and $P_{s2}$ will produce equal and opposite forces on the spool 280.

Control pressure $P_{c1}$ enters control 204 at port 222. As seen in FIGS. 8 and 17 and as schematically shown in FIG. 7, the command signal at pressure $P_{c1}$ moves through a passage 420 to a check valve 422 and through an orifice 424. After the fluid at pressure $P_{c1}$ passes through check valve 422 it moves along a passage 426 and is designated $P_{c0}$. The control pressure $P_{c0}$ is directed by passage 426 to chamber 310. As seen in FIG. 18 and FIG. 19, spool 280 includes an opening or hole 428 which communicates bore 292 with chamber 310. Fluid at pressure $P_{c0}$ passes, therefore, through hole 428, bore 292 and through an orifice 432 (FIG. 8). The fluid then enters passage 346 of servo 280 and is directed to the tank drain passage 96". The control pressure fluid that passes through orifice 424 move through passages 438 and through recess 314 to chamber 238 in pilot bore 228. This command pressure is designated $C_1$ in FIG. 7.

Control pressure $P_{c2}$ moves from port 224 to passage 448 and through a check valve 450 (FIG. 17) to passage 426. After the control pressure $P_{c2}$ passes through the check valve 450, it is also designated as pressure $P_{c0}$.

Pressure $P_{c0}$ is communicated through passage 426 to chamber or cavity 310. Control pressure fluid $P_{c2}$ also passes through an orifice 454 to passages 456. The control pressure is then designated $C_2$ in the schematic of FIG. 7. Passages 456 as seen in FIGS. 15 and 17 move vertically within the body 220 to direct fluid $C_2$ to chamber 236 where it is brought into contact with piston 234 and to the second command pressure chamber or recess 318 defined by spool 280 and bore 226.

The pressure $P_{c0}$ in cavity 310 acts on an area of the servo spool 280 equal to the effective area exposed to pressure $P_{s2}$ in chamber 312 and equal to one-half the area exposed to pressure $P_{s1}/2$ in chamber and cavity 320. The remaining force acting on spool 280 is created by spring 282. The force created by spring 282 is selected to be equal to the step function increase in pressures $P_{c1}$ and/or $P_{c2}$ that occurs at a ten degree lever rotation as illustrated in the graph of FIG. 5. The system is designed so that this step increase in pressure $P_{c1}$ or $P_{c2}$ is sufficient to cause the valve spool 92 to move a sufficient distance to start flow between passages 102, 104 to the selected cylinder port thereby creating the pressure differential $(P_{s1}-P_{s2})$. The force, therefore, acting downwardly on the spool 280 is as follows:

$$P_{s1}/2\times A_{320}+F_s$$

wherein $F_s$ is the force generated by spring 282.

The force acting to move spool 280 upwardly is as follows:

$$P_{c0}A_{310}+P_{s2}A_{312}$$

Given the above relationship between the areas upon which the various pressures act, and given the fact that the spring force $F_s$ is selected to be equal to the set point or step pressure increase from the hydraulic remote controllers the servo spool will be in balance when the following relationship exists:

$$(P_{s1}-P_{s2})=P_{c0}$$

As a result, the controller will function to maintain a specified or expected flow rate through valve 202 which is directly proportional to the command signal $P_{c1}$ or $P_{c2}$.

In operation, a pressure signal $P_{c1}$ is applied to port 222. As the pressure signal is increased to approximately one-half of the maximum pressure for $P_{c1}$ the force from the pressure $P_{c0}$ in cavity 310 will balance the force from spring 282 or move upwardly from the initial position illustrated in FIG. 8. When in the initial position, fluid at pressure $P_{c1}$ has passed through orifice 424 and entered passages 438 to be directed to chamber 238 and also to the tank or drain through recess 314, 316. As the spool moves upwardly, land 298 blocks off recess 316 preventing drainage of the fluid at pressure $C_1$. Chamber 238 will, therefore, become pressurized. Fluid within chamber 236 will pass backwardly through passages 456 as piston 234 moves. The pressure $C_1$ acting in chamber 238 and on piston 234 will increase causing the spool 92 to move to the right when viewed in FIG. 8 and to the left when viewed in FIG. 6. As a result, flow starts in the valve to port 108. The pressure $P_{s2}$ in cavity or chamber 312 will not decrease until the spool 280 is in balance.

If only a single valve in the valve bank is actuated, one of the lands 144 restrict flow through the center of the valve bank resulting in $P_{s1}$ being approximately the same amount greater than $P_{s2}$ as pressure $P_{c0}$ is greater than the pressure required to balance spring 282. If another valve in the bank is activated in a manner which requires a pressure to a cylinder port in its valve which is higher than the pressure $P_{s2}$ in the first valve actuated, the flow rate to port 108 will increase. This will cause an increase in differential pressure $(P_{s1}-P_{s2})$ in the first valve actuated. This increase will in turn cause spool 280 to move to open passage 438 and recess 314 to tank through recess 316. The spool, in other words, with the increase in pressure $P_{s1}$ will be moved downwardly. As a result, the pressure within chamber 238 will decrease causing spool 92 to move towards the center until land 146 restricts flow to port 108. This movement will continue until the differential pressure $(P_{s1}-P_{s2})$ is approximately equal to $P_{c0}$.

The control 204, therefore, provides pressure compensation individually to its associated valve in a multiple valve bank. The pressure compensation action maintains a flow rate in the valve, which is proportional to the differential pressure, substantially constant regardless of the pressure required at other valve spools Each valve is, therefore, individually pressure compensated.

As the pressure $P_{c1}$ increases, the pressure acting in cavity 310 likewise increases causing an increase in the flow rate between passages 102, 104 to increase the differential pressure $(P_{s1}-P_{s2})$ until such is equal to $P_{c0}$. As the pressure $P_{c1}$ decreases, flow of fluid from chamber 310 through orifice 432 allows the pressure $P_{c0}$ to decrease to pressure $P_{c1}$. This shifts the valve spool 280 downwardly causing an increase of flow from passage 438 to the tank through recess 316. As a result, spring 252 will shift valve spool 92 to decrease flow to port 108 until the differential pressure $(P_{s1}-P_{s2})$ is equal to $P_{c0}$.

When the pressure $P_{c2}$ is increased to one-half the maximum pressure, spool 92 will move to the right when viewed in FIG. 6 and the left when viewed in FIG. 8. As the command pressure $P_{c2}$ increases and decreases, the flow to port 110 will be controlled in exactly the same manner as set forth above. Spool 280 will be positioned to control flow between passages 456 and the tank or drain recess 316 through the positioning or movement of land 300 within the servo bore.

The control subassembly in accordance with the present invention individually can pressure compensate standard series/parallel type mobile valves or any directional valves connected in parallel The flow rate through the mobile valve is sensed by sensing the differential pressure between an input passage and an output or pressure passage across the load holding check valve. This pressure differential is fed back to the servo which acts as a summing device The servo moves as required to maintain a command force equal to the pressure drop times an affective area. The control functions to move a four-way or three-way valve spool in a manner which causes the command force to match the feedback force. Significant improvements in valve operation are achieved.

INDIVIDUALLY PRESSURE COMPENSATED PROPORTIONAL ELECTRIC REMOTE CONTROL VALVE

An alternative embodiment of the present invention is illustrated in FIGS. 20–25. In the alternative embodiment, the hydraulic remote regulators and controls are eliminated. Proportional electro-hydraulic pilot valves are substituted. Such valves generate the command pressure signals $P_{c1}$ and $P_{c2}$. In the drawings, elements which are the same as those illustrated in the prior embodiment are designated with the same numerals.

Figure 20:
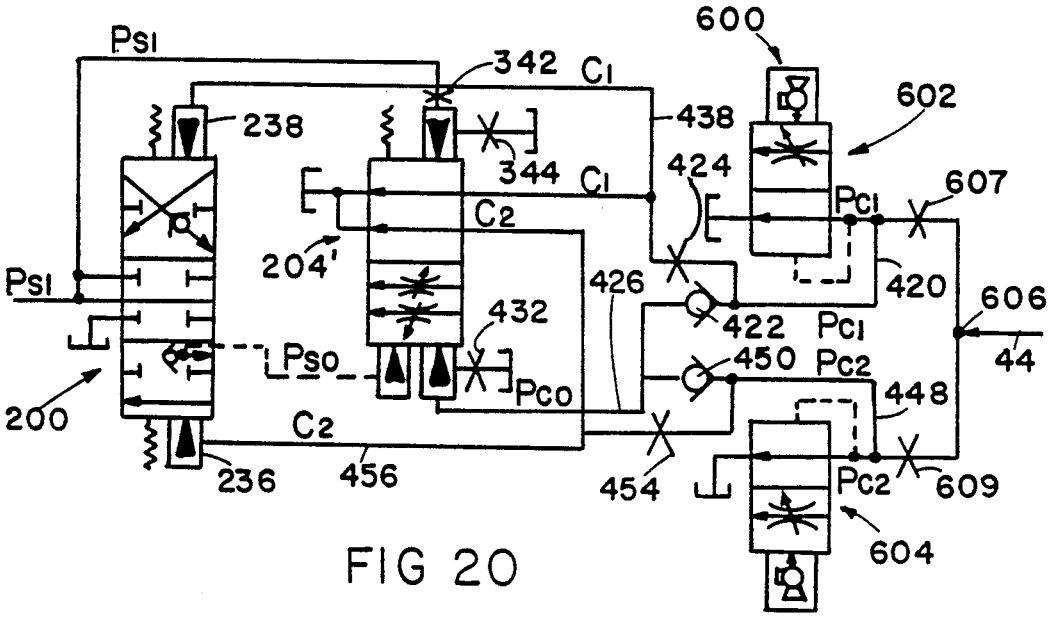
FIG. 20 is a schematic of an individually pressure compensated proportional electric remote control valve in accordance with the present invention.

As schematically shown in FIG. 20, the alternative embodiment includes control means 204' for positioning a valve spool in a three or four-way directional valve 200. A proportional solenoid subassembly 600 includes two proportional solenoids 602, 604. Assembly 600 includes an inlet port 606 connected to a source 44 of control fluid at a pressure $P_c$. As schematically shown in FIG. 20, source 44 is connected to solenoids 602, 604 through orifices 607, 609. Also solenoids 602, 604 are connected to output passages 420, 448, respectively Passage 420 transmits hydraulic fluid at a command pressure $P_{c1}$. Passage 448 transmits hydraulic fluid at a command pressure $P_{c2}$. The pressure signals are directed to the control device 204' in the same fashion as in the prior embodiment.

As schematically shown in FIG. 20 and as illustrated in FIGS. 21–25, device 204' includes a body having a portion 220'. Portion 220' defines inlet port 606 and a pair of opposed bores 610, 612 which receive solenoid assemblies 602, 604. Inlet port 606 communicates with a bore 616 containing a tubular valve element 618. The proportional solenoid subassemblies 602, 604 are identical. Assembly 602 includes a ball valve 622 contained in a bore 624 of element 618. Element 618 defines orifices 607, 609 and ball valve seats 626. The solenoid components including a shell 630, a pole piece 632, a lower pole piece 634, a nonmagnetic pressure vessel 636, an armature 638 and a coil 640 are within bore 610. The solenoid defines an air gap 644 between armature 638 and pole piece 634. A push rod 648 extends from the armature and into contact with ball 622.

Armature 638 includes a pair of circumferential, vertically spaced grooves 652, 654. Positioned within grooves 652, 654 are nonmagnetic balls 656. The depth of the grooves and the diameter of the balls are selected such that the armature only contacts the nonmagnetic pressure vessel through the balls. This insures that the friction between the armature and the pressure vessel will always be rolling friction. The structure reduces the frictional force acting on the armature to a point approaching a zero friction level The armature is, therefore, suspended in a near frictionless mount.

As seen in FIGS. 21–25, the control fluid entering port 606 passes through a central orifice or restrictor 680 in element 618, through orifices 607, 609 and into vertically opposed bores 682, 684. Fluid flowing in bore or passage 682 can pass around ball 622 into a chamber 686 which is connected to tank through a drain. Fluid passing through passage 684 can pass around ball 622 of solenoid 604 to another chamber 688 which is also connected to tank. When the respective balls 622 are moved against their seats on element 618, output pressures $P_{c1}$ or $P_{c2}$ are generated in passages 682, 684, respectively.

Figure 23:
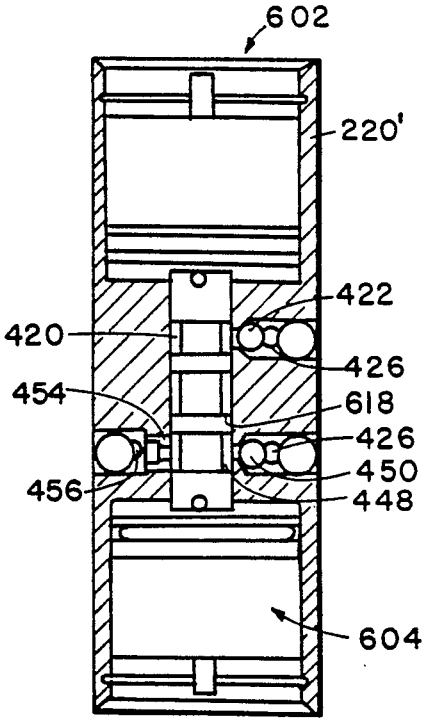
FIG. 23 is a cross sectional view taken generally along line XXIII—XXIII of FIG. 21.
Figure 24:
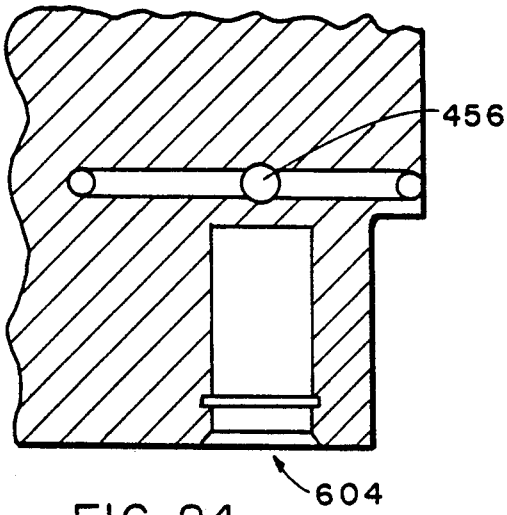
FIG. 24 is a cross sectional view taken generally along line XXIV—XXIV of FIG. 22.
Figure 22:
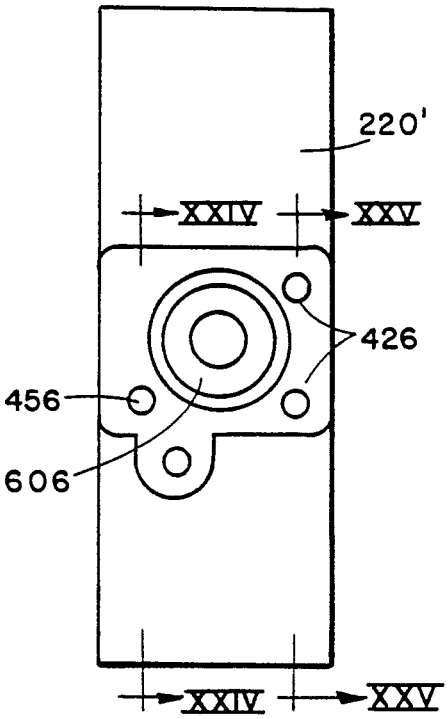
FIG. 22 is an end, elevational view of the valve of FIG. 21.
Figure 25:
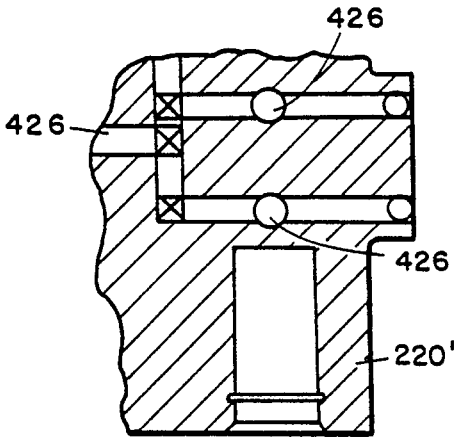
FIG. 25 is a cross sectional view taken generally along line XXV—XXV of FIG. 22.

When ball 622 is moved towards its closed position by solenoid 602, fluid will flow through orifice 424 (FIG. 21) and into passage 438 where it becomes command signal $C_1$ as in the prior embodiment Fluid at pressure $C_1$ moves through passages 438 to chamber 238 of the pilot bore and to recess or chamber 314 of the servo spool. In addition, as shown in FIG. 23, the fluid will pass through passage or recess 420 to check valve 422 and hence into passages 426 where it is directed to chamber 310 defined by the control at the command pressure $P_{c0}$. When solenoid 604 is actuated to move its ball 622 towards its seat, fluid can pass through passage or recess 448 and by check 450 and into passage 426 at the command pressure $P_{c0}$. Fluid also passes through restricted orifice 454 into passages 456 where it becomes command signal $C_2$ as in the prior embodiment. Such fluid is directed to the chamber 236 in the pilot bore of the control and to recess 318 of the servo spool 280. The operation of the control and directional valve in the embodiment of FIGS. 20–25 is identical to that of the prior embodiment.

Operation of proportional electro-hydraulic pilot valve 600 should be apparent from the above description. When zero electrical current passes to solenoid valve assembly 602, ball 622 is moved away from its seat by fluid flowing by the ball. Command pressure $P_{c1}$ will be at its minimum value. As electrical current increases from zero, lines of flux are produced by coil 640. The path of least resistance for the flux is through the steel, the shell, the pole pieces, the radial air gap formed by the nonmagnetic pressure vessel and the armature, the working air gap and pole piece 634. The magnetic flux causes the armature and pole piece to be polarized. Armature 638 is attracted to pole piece 634. Push rod 648 engages and moves ball 622 towards its seat 626. The tractive force generated by the armature and pole piece is opposed by the pressure $P_{c1}$ acting on the ball. The pressure $P_{c1}$ therefore becomes a function of the electrical current passing through the coil 640. As the ball moves towards its seat, fluid at pressure $P_{c1}$ is directed to the summing device to actuate the directional valve and solenoid subassembly 604 is in its open position. Chamber 236 of the pilot valve bore is open to drain through chamber 688. With solenoid 602 in the open position and solenoid 604 actuated, assembly 600 generates the control pressure signal $P_{c2}$. Control 204' functions in the same fashion as control 204 to pressurize chamber 236. Chamber 238 will drain through chamber 686. The proportional solenoids, therefore, provide remote electrical actuation of the hydraulic control valve 200. The rate of flow through the valve is directly proportional to the positioning of a control which sets the current level through the solenoids.

INDIVIDUALLY PRESSURE COMPENSATED ELECTRIC REMOTE VALVE EMPLOYING ON-OFF SOLENOIDS

Figure 27:
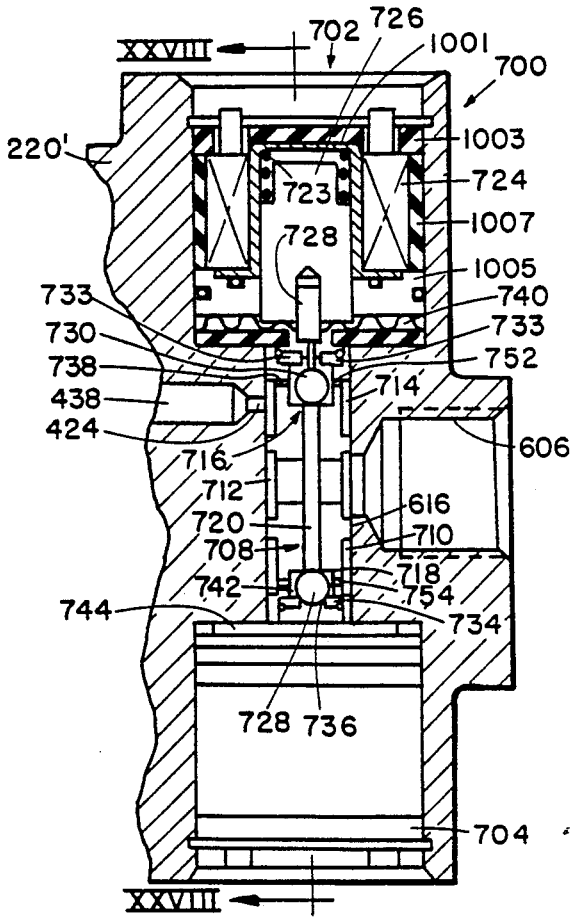
FIG. 27 is a fragmentary, cross sectional view of a control in accordance with the present invention including on/off solenoid actuators as schematically shown in FIG. 26.
Figure 26:
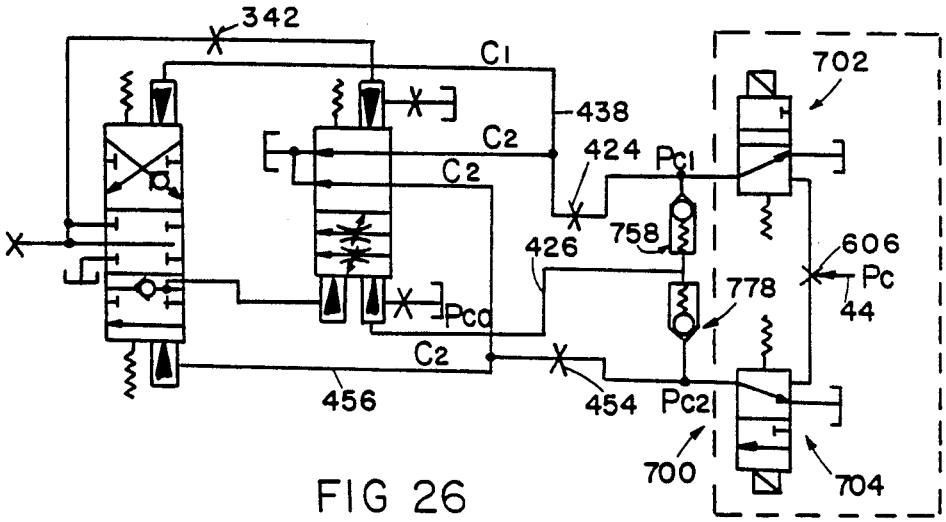
FIG. 26 is a schematic of a individually pressure compensated solenoid control valve embodiment in accordance with the present invention.
Figure 28:
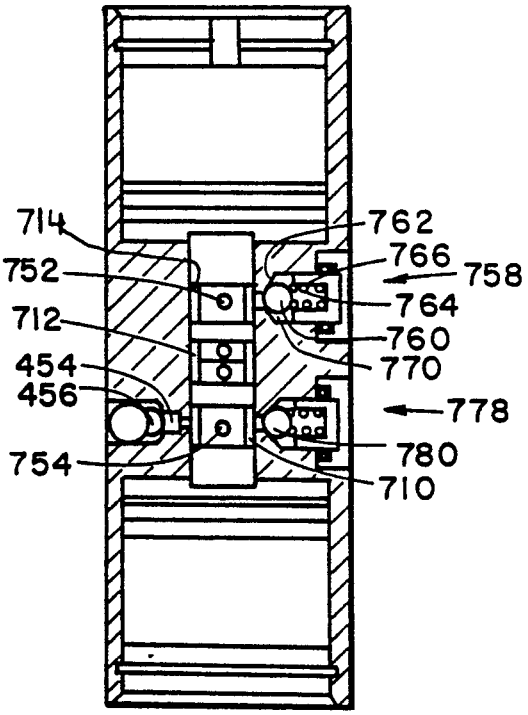
FIG. 28 is a cross sectional view taken generally along line XXVIII—XXVIII of FIG. 27.

A further alternative embodiment of the present invention is illustrated in FIGS. 26–28. In this embodiment, an on-off solenoid valve assembly 700 replaces the proportional solenoid valve assembly 600 of the embodiment in FIG. 20. As schematically shown, assembly 700 includes a pair of opposed on-off solenoids 702, 704. Solenoids 702, 704 are positioned within body 220'. Body 220' includes inlet port 606 connected to a source 44 of control fluid at pressure $P_c$. A valve defining element 708 is positioned within bore 616 of body 220'. Element 708 includes a plurality of grooves 710, 712 and 714. One end of element 708 defines a lower valve seat 716 and an upper valve seat 734. The opposite end of element 708 defines a lower valve seat 718 and an upper valve seat 734. Inlet passage 606 is connected to the seats 716, 718 by a passage 720. Each solenoid subassembly 702, 704 includes a spring 723, a coil 724, an armature 726, a non-magnetic pressure vessel 1001, an upper pole piece 1003, a lower pole piece 1005, a shell 1007, and a working air gap 1009. Armature stems 728 extend from armatures 726 and into contact with respective ball valves 730. Armature stem 728 extends through upper valve seats 733, 734. Ball 730 of on-off solenoid 702, therefore, moves within a chamber 738. Downstream of chamber 738 is another chamber 740. Chamber 740 is connected to the tank or drain. Solenoid 704 similarly includes a chamber 742 within which its ball 730 moves. Downstream of chamber 742 is another chamber 744 which is connected to a tank or drain. The ball chamber of solenoid valve assembly 702 is connected to recess 714 by a drilled passage 752 (FIG. 28). Ball chamber of solenoid valve 704 is connected to recess 710 by a drilled passage 754. As seen in FIGS. 26 and 28, recess 714 communicates with orifice 424 and hence with passage 438 (FIG. 27) and with a direct acting relief valve assembly 758 (FIG. 28). Relief valve assembly includes a ball 760 biased against a seat 762 by a spring 764. An opposite end of spring 764 engages an adjustable cap 766. Relief valve 758 is disposed within a chamber 770. Chamber 770 is connected to passage 426.

Recess 710 adjacent solenoid assembly 704 communicates through a drilled port with a restricted orifice 454 and hence to passages 456 (FIG. 28). Recess 710 also communicates through a drilled port to another direct acting relief valve 778 (FIGS. 26 and 28). Valve 778 is identical to valve 758. Valve 778 is disposed within a chamber 780. Chamber 780 is connected through a suitable drilled passageway to passage 426. Control or command pressure signal $P_{c0}$ is, therefore, transmitted to chamber 310 of the servo spool valve through the direct acting relief valves 758, 778. The command actuating pressure $C_1$ is transmitted through passages 438 selectively to the pilot bore chamber or tank depending upon the position of the spool valve. Command actuating pressure $C_2$ communicates through passages 456 with pilot bore chamber 236. As in the first embodiment, passages 456 are vented to tank through the servo spool.

The embodiment of FIGS. 27–28 provides fixed control pressures $P_{c1}$ and $P_{c2}$. Springs 723 of each of the on-off solenoids 702, 704 are selected to provide a sufficient force to hold balls 730 on their respective seats against the maximum control pressure $P_c$. When an electric current passes through one of the solenoids, its armature will be retracted forcing the ball 730 off of its lower seat 716 or 718 and against its upper seat 733, 734 sealing the passage from tank. Actuation of valve 702, therefore, permits the control pressure $P_{c1}$ to be communicated to passages 438 and 426 through direct acting relief valve 758. With solenoid 704 in the off position, bore chamber 236 adjacent the pilot piston is permitted to vent to tank through chamber 744. The direct acting relief valves set the limit for control or command pressure signal $P_{c0}$. This in turn limits the maximum differential pressure that can occur across the load holding check valve of the four-way directional valve and hence the maximum flow rate.

Figure 29:
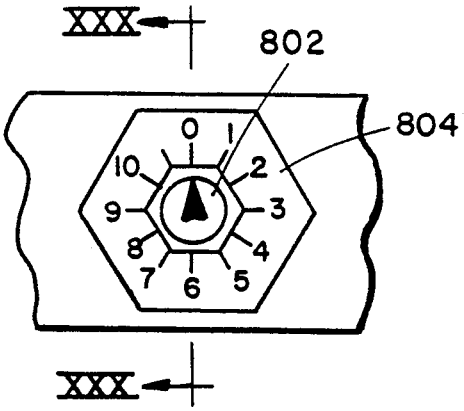
FIG. 29 is a top, plan view through a load holding check valve alternative in accordance with the present invention.
Figure 30:
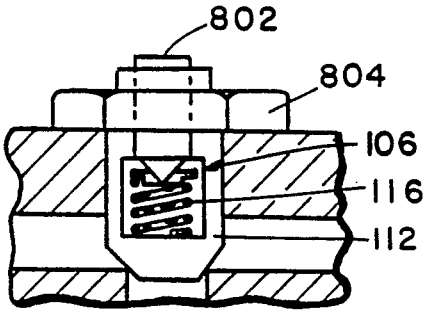
FIG. 30 is a cross sectional view taken generally along line XXX—XXX of FIG. 29.
Figure 31:
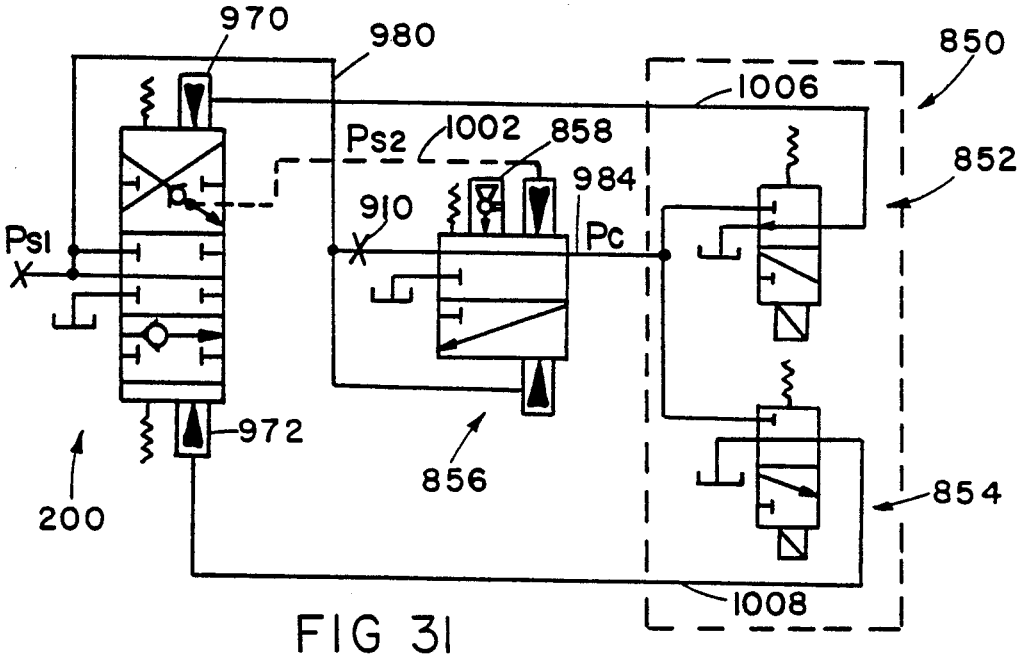
FIG. 31 is a schematic of an individually pressure compensated, electro-hydraulic remote controlled valve wherein the command signal to set the flow rate of the directional valve is an electromagnetic force.

In order to permit adjustment of the maximum flow rates at the directional valve, provision is made for adjusting the preload on the check valve spring 116. As shown in FIGS. 29 and 30, check valve element 112 is held against its seat by spring 116. An adjustable screw 802 is threaded through a cap 804 fixed to the valve body. As screw 802 is moved in and out, the preload on spring 116 is adjusted to change the maximum flow rate as indicated on the dial formed on cap 804. If the relief valves are set at a low differential pressure and both are set at the same differential pressure, the maximum pressure signal available in cavity or chamber 310 of the servo spool can be considered as fixed at a value X. If adjusting screw 802 is adjusted inwardly to the "position 1" indicated in FIG. 29, the flow rate across the load holding check valve 106, results in a differential pressure ($P_{s1}-P_{s2}$) of value X will be approximately 10% of the maximum flow permitted. If the screw is set at "position 5" indicated in FIG. 29, the flow rate across the load holding check valve that causes a differential pressure will be approximately 50% of the maximum flow rate. Screw 802, therefore, permits the maximum flow rate to be adjusted at the directional valve in an electro-hydraulic control system wherein the solenoid valves are on-off valves. Actuation of the solenoids results in the maximum set flow in the directional valve to a selected cylinder port. The valves are, however, individually pressure compensated as in the prior embodiments.

INDIVIDUALLY PRESSURE COMPENSATED ELECTRO-HYDRAULIC REMOTE CONTROLLED VALVE WITH AN ELECTRO-MAGNETIC FORCE COMMAND SIGNAL

With the prior embodiments, the command signal to set the rate of flow through the directional valve and against which the pressure differential ($P_{s1}-P_{s2}$) was compared in the summing device and servo valve, was a fluid pressure signal. The command force or signal compared to the pressure differential may, however, be generated electromagnetically. In the embodiment of FIGS. 31–40, a control means 850 includes a first on-off solenoid valve 852, a second on-off solenoid valve 854 and a summing device and servo valve means 856. Valve means 856 includes a proportional solenoid 858 which generates a command signal or command force. The proportional solenoid 858, in effect, generates the control signal $P_{c0}$ employed in the previous embodiments to set the flow rate in the directional valve.

As seen in FIGS. 32–40, control means 850 includes a drilled and bored body 862. Body 862 defines a pair of opposed bores 864, 866 which receive the on-off solenoid assemblies 852, 854. Body 862 further defines another bore 870 which receives the proportional solenoid assembly 858. Coaxial with bore 870 is a blind bore 872. A servo spool or summing device 874 is positioned within bore 872. Body 862 further defines a pilot bore 876. Piston 234 and spring assembly 244 are within bore 876. Piston 234 divides bore 876 into chambers 970, 972. Spring assembly as in the prior embodiments includes a coil spring 252 which cooperates with retainers 246, 250. Piston 234 is connected to spool 92 of the directional valve through fastener 242.

Figure 21:
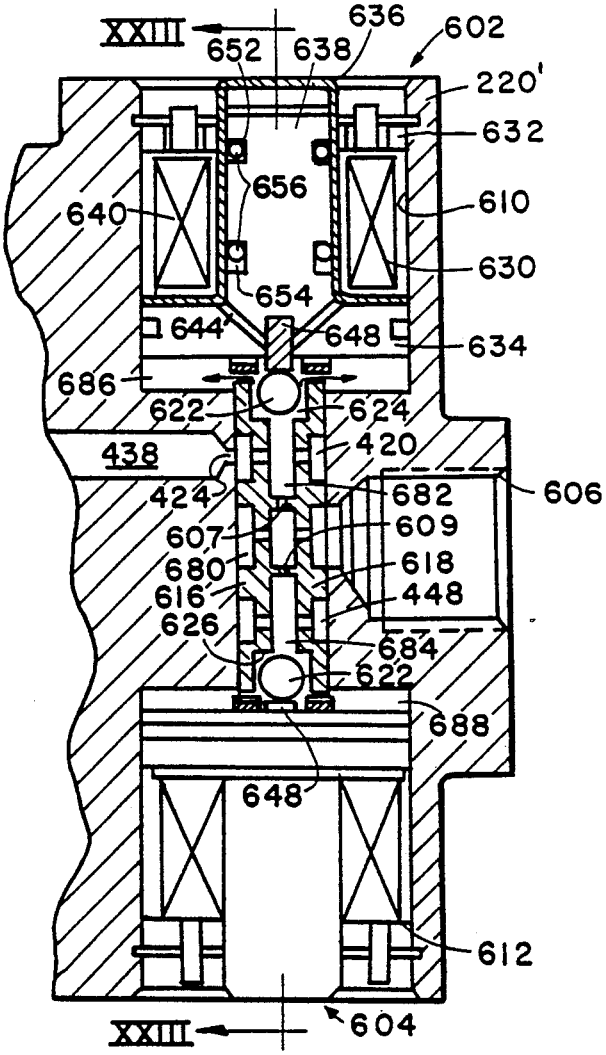
FIG. 21 is a fragmentary, cross sectional view showing the proportional electro-hydraulic pilot valve incorporated in the embodiment of FIG. 20.

Proportional solenoid 858, which is essentially the same as solenoid 602 of FIG. 21, includes a coil 882, an armature 884 and an armature stem 886. Stem 886 is positionable into engagement with servo spool 874. A spring 888 biases armature 884 towards bore 872 and into engagement with spool 874. Spool 874 includes a blind bore 890, a lower groove 892, intermediate, spaced grooves 894, 896 and an upper groove 898. The effective top and bottom areas 897, 899 of spool 874 are equal. The grooves are separated by lands 900, 902, 904 and 906. Bore 890 communicates with groove 896 through an orifice 910. Bore 870 containing solenoid 858 defines a chamber 912 above spool 874.

Figure 32:
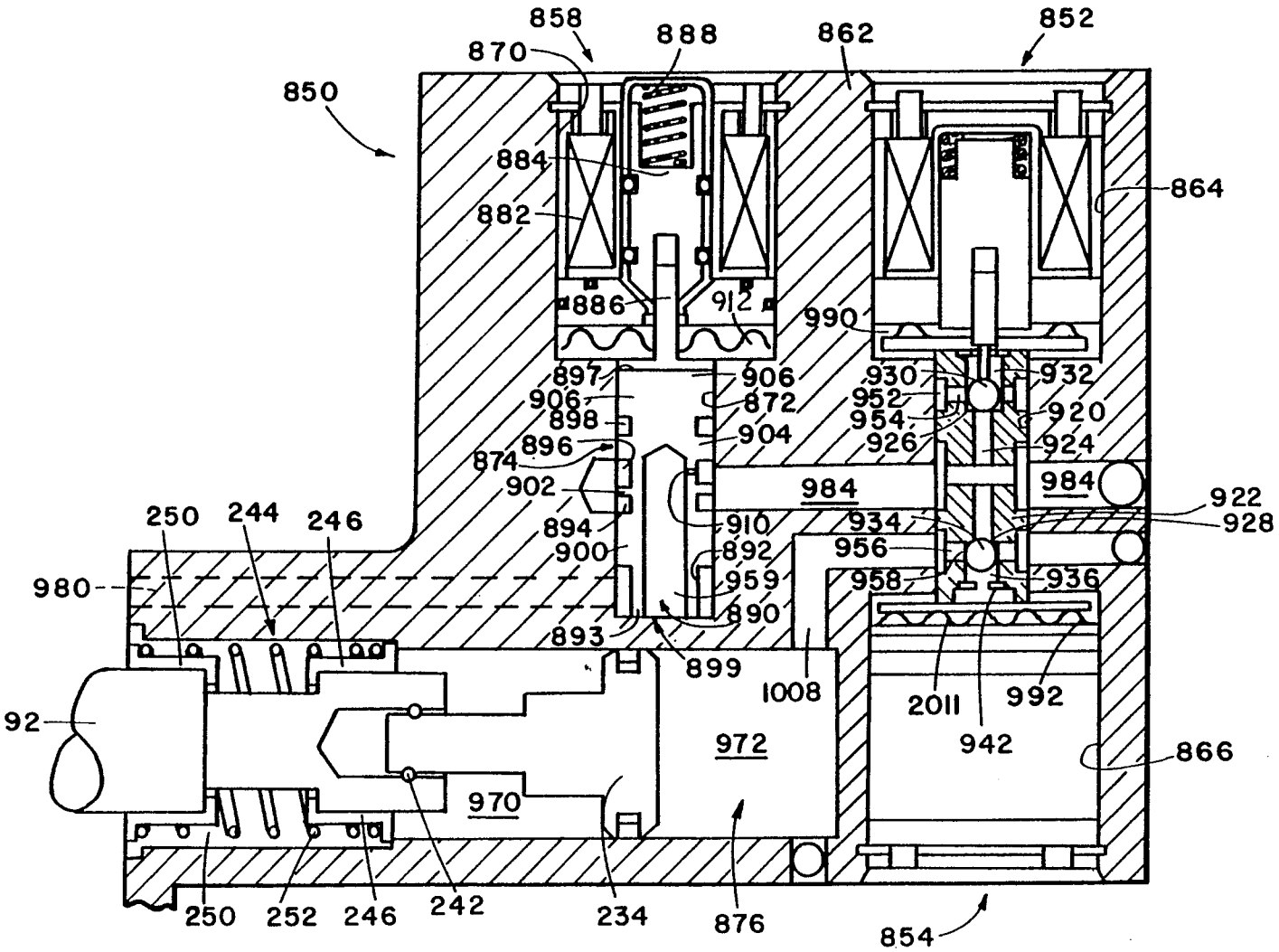
FIG. 32 is a side, elevational view of the control incorporated in the embodiment of FIG. 31.
Figure 40:
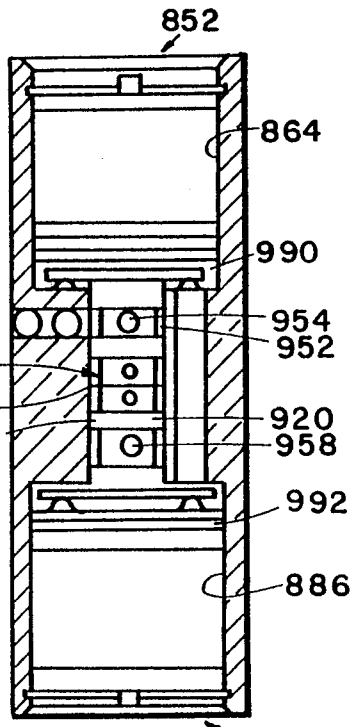
FIG. 40 is a cross sectional view taken generally along line XL—XL of FIG. 35.

A bore 920 interconnects bores 864, 866 as seen in FIG. 32 and FIG. 40. Valve seat and passage defining element 922 is disposed within bore 920. Element 922 defines a central passage 924 which terminates at opposed seats 926, 928. An upper ball valve 930 is positioned within a ball chamber 932 defined by element 922. Another ball valve 934 is positioned in an opposite chamber 936. Element 922 also defines an upper seat 940 and a lower seat 942. Chamber 932 communicates with a recess 952 through ports or bores 954. Chamber 936 communicates with a recess 956 through ports or bores 958.

As shown in FIGS. 32–40, body 862 defines a passage network formed by drilling the body and selectively plugging the drilled apertures. The body includes an inlet port and passage 980 which communicates fluid from inlet passage 102 of the directional valve at a pressure $P_{s1}$ to the control means. Passage 980 connects with bore 872 and recess 892 of the servo spool is exposed to a pressure $P_{s1}$. A passage 959 in spool 874 communicates the fluid within the chamber or recess 892 with bore 890. Fluid at pressure $P_{s1}$ then passes through an orifice 910 to groove 896.

As seen in FIGS. 32 and 40, a passage 984 communicates the fluid to the central recess and vertical passage 924 in element 922 at the on-of solenoid subassemblies. As shown in the schematic illustration of FIG. 31, after the fluid at pressure $P_{s1}$ passes through orifice 910 and into passage 984 is designated as pressure $P_c$.

Figure 38:
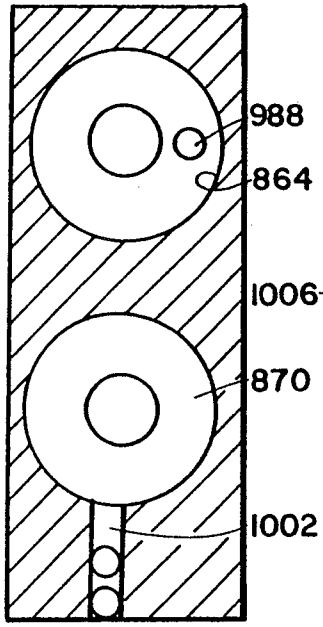
FIG. 38 is a cross sectional view taken generally along line XXXVIII—XXXVIII of FIG. 33.
Figure 37:
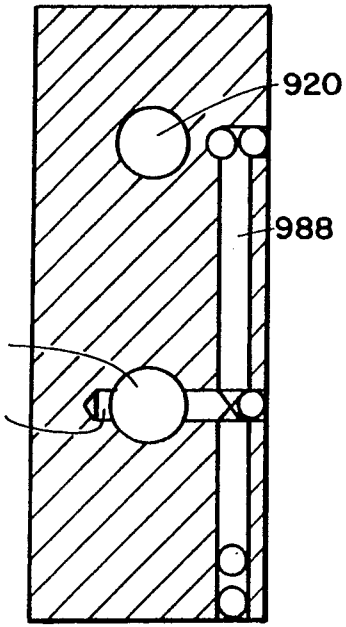
FIG. 37 is a cross sectional view taken generally along line XXXVII—XXXVII of FIG. 33.

Body 862 further defines a drain port and passage 988. Passage 988 communicates with chambers 990, 992 at the on-off solenoid valves. Passage 998 also communicates with a passage 994 opening into bore 872 containing servo spool 874 (FIGS. 37, 38 and 40).

Figure 39:
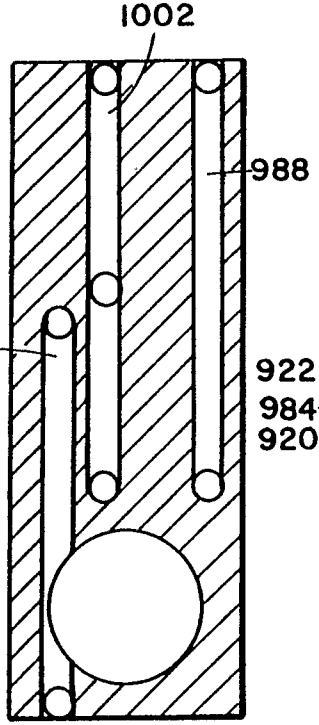
FIG. 39 is a cross sectional view taken generally along line XXXIX—XXXIX of FIG. 35.
Figure 36:
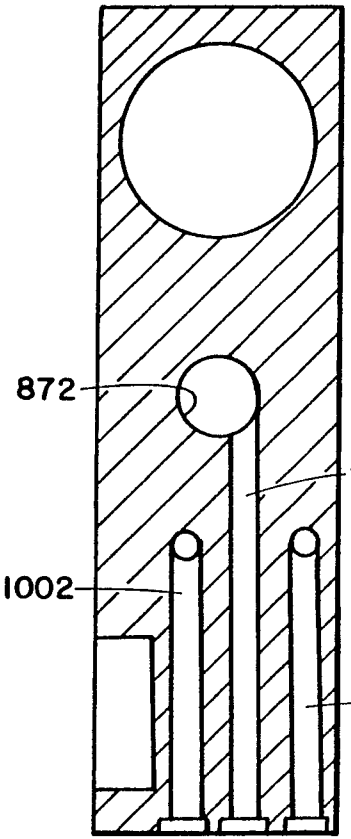
FIG. 36 is a cross sectional view taken generally along line XXXVI—XXXVI of FIG. 33.

Fluid at pressure $P_{s2}$ from pressure passage 104 of the directional valve enters body 862 at port and passages 1002. Passages 1002 as seen in FIGS. 36, 38 and 39 communicate the fluid at pressure $P_{s2}$ to chamber 912 between the proportional solenoid and the servo spool. With ball 930 against seat 926, chamber 970 of valve bore 876 communicates with chamber 990 through passages 1006. Chamber 972 of the valve bore is placed in communication with passages 984 through the on-off solenoid 854 and passage 1008 as seen in FIGS. 32 and 40.

In view of the above description, the operation of the embodiment of FIGS. 31–40 should be apparent. Fluid at pressure $P_{s1}$ is communicated to the lower chamber defined by groove 892 and the bore 890. This fluid acting on the spool effective area generates a vertical force which is opposed by fluid at pressure $P_{s2}$ in chamber 912. The fluid from bore 890 passes through restricted orifice 910 and enters chamber passages 984 at a pressure $P_c$. Upon activation of solenoid 852, its respective valve opens and fluid at pressure $P_c$ is transmitted through passages 1006 to chamber 970. The pressure $P_c$ acts on piston 234 causing the valve spool 92 to move to restrict flow through its center until flow starts to the outlet cylinder port 108. As soon as flow starts between inlet passage 102 to the outlet passage 104 across load holding check valve 106, the pressure $P_{s2}$ in cavity or chamber 912 and acting on spool area 897 will become less than the pressure $P_{s1}$ in chamber 893 and acting on spool area 889. The valve spool is configured so that the areas in contact with pressures $P_{s1}$ and $P_{s2}$ are equal. Once the pressure $P_{s1}$ is sufficient to counter the force of spring 888, the servo spool will move up until groove 896 starts to open to the tank passage 994. Orifice 910 reduces the pressure $P_{s1}$ to pressure $P_c$ which will balance the force from spring 252 within the pilot bore. The spool 92 will be maintained at a low flow rate to cylinder port 108.

A command force or equivalent command pressure signal may now be generated by proportional solenoid 858. As electrical current flows through the coil of the solenoid, the force from armature 884 will increase causing an unbalance on the servo spool 274 downward. This unbalance will cause pressure $P_c$ to increase resulting in shifting of spool 92 towards a more open position increasing flow between passages 102, 104 and thereby increasing the pressure differential ($P_{s1}-P_{s2}$). The flow to the cylinder port 108 will increase until the pressure differential acting on the spool 874 is sufficient to balance the force from the proportional solenoid armature. As the rate of electrical current to the coil of the armature of the solenoid increases, the flow rate measured by the pressure differential will increase in each case to the point where the servo spool is in balance which in turn adjusts the pressure $P_c$ to the point that spool 92 will maintain the selected flow rate to the cylinder port.

When on-off solenoid 852 is actuated to direct flow to the passage 1006, bore chamber 876 behind piston 234 is connected to tank through passage 1008 and chamber 992. When current is cut to solenoid 852 and solenoid 854 is actuated, modulated control pressure $P_c$ is directed to chamber 972. The force or command pressure generated by the proportional solenoid will be balanced by the pressure differential to obtain the desired pressure signal $P_c$ to position piston 934 to position the directional valve spool 92. The embodiment of FIGS. 31–40, therefore, employs the differential pressure at the load holding check valve of the directional valve as a feed back signal to control positioning of the valve spool to achieve a flow rate which is proportional to an input command pressure or force signal. The force signal is, however, electrically generated through a proportional solenoid.

SINGLE STAGE INDIVIDUALLY PRESSURE COMPENSATED HYDRAULIC REMOTE CONTROL VALVE

Figure 41:
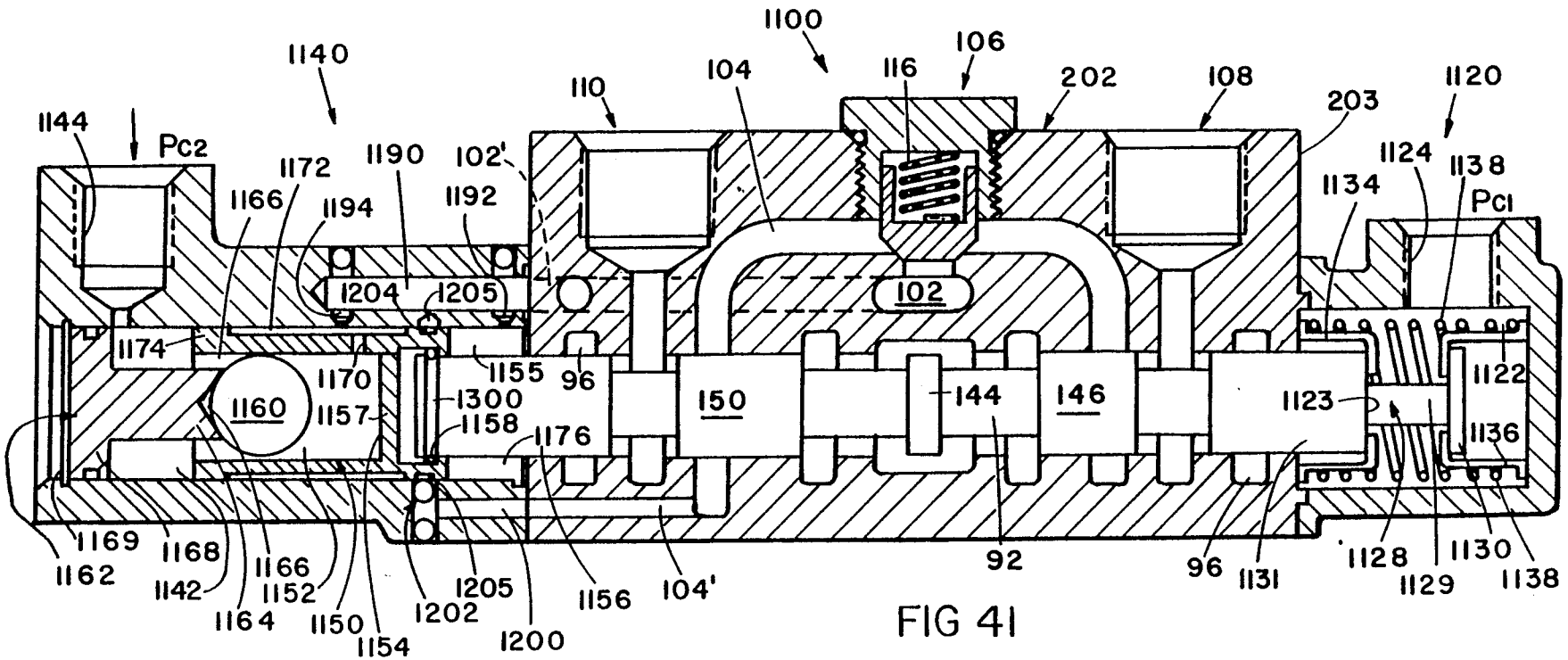
FIG. 41 is a cross sectional view of a single stage individually pressure compensated hydraulic remote control valve in accordance with the present invention.

FIG. 41 illustrates a still further alternative embodiment of the present invention incorporated in a single stage hydraulic remote controlled valve. The prior embodiments have been two stage control valves employing a summing device and servo spool to generate a command pressure signal acting on a piston which in turn is connected to and positions the directional valve spool. In two stage devices, the summing device and control means does not sense the secondary forces acting on the directional valve spool. Also, the summing device can provide increased gain to overcome such secondary forces. More precise control can be obtained. The present invention can, however, be applied to a single stage valve resulting in cost advantages. The directional valve will still obtain improved flow rate metering. The flow rate will be generally proportional to input signal. The same degree of accuracy of output flow rate versus the input signal will not, however, be obtained. The output is affected by Bernouilli effect forces resulting from the acceleration of the fluid mass across the directional valve spool, radial unbalance of the valve spool and frictional forces acting on the valve spool. The basic concept of the present invention of comparing a flow rate feedback signal to a command signal will, however, provide greatly improved flow rate metering.

FIG. 41 illustrates a single stage version of an individually pressure compensated hydraulic valve in accordance with the present invention and which is generally designated by the numeral 1100. Embodiment 1100 includes a directional hydraulic control valve 202 having a body 203 and a directional spool valve 92 as in the prior embodiments. Valve 202 also includes the load holding check valve 106, input pressure passage 102, output pressure passage 104, cylinder ports 108, 110 and tank passages 96. In embodiment 1100, directional valve spool 92 functions as the servo spool of the prior embodiments.

The control means includes a first end cap 1120 which defines a bore 1122 and an inlet port 1124. Port 1124 is connected to a remote regulator or other device to receive control fluid at pressure $P_{c1}$. An extension 1128 having a stem or rod 1129 and a flange or piston 1130 is fixed to an end 1131 of spool 92. End 1131 has an area 1123. Centering spring subassembly is disposed within bore 1122. Spring subassembly includes a first retainer 1134 which engages end 1131 of spool 92 and a second retainer 1136 engages flange 1130. A coil spring 1138 extends between retainers 1134, 1136. The spring assembly, therefore, as in the prior embodiments centers spool 92 and resists movement of spool 92 in either direction. A second end cap assembly 1140 is secured to the opposite end of valve 202. End cap assembly 1140 defines a bore 1142 and an input port 1144. Port 1144 is connected to a remote hydraulic control regulator or other device and receives fluid at a pressure $P_{c2}$. An input device such as a lever operating on a pair of regulators selectively, as shown in FIG. 1, directs the control pressure inputs $P_{c1}$ and $P_{c2}$ to their respective inlet ports 1124, 1144. In the alternative, remotely operated proportional solenoids could be used to generate the control inputs or signals.

A summing control piston 1150 is positioned within bore 1142 of end cap 1140. Control piston 1150 defines a bore or cavity 1152 having an area 1154 at one end. Summing control piston 1150 is connected to an end 1156 of Valve spool 92 by a wire ring 1158 and within a cavity or chamber 1155. Piston 1150 defines a right side area 1157 which is opposite area 1154. A ball 1160 is also disposed within bore 1152. Ball 1160 abuts a plug 1162. Plug 1162 includes a stem portion 1164 defining a concave seat 1166 and a circular flange 1168. Flange 1168 is held in place by a snap ring 1169.

Piston 1150 defines a passage o port 1170 which communicates bore 1152 with a groove or recess 1172. Piston 1150 includes a left end area 1174. The opposite or right end of piston 1150 defines an end area 1176.

System pressure $P_{s1}$ is ported from passage 102 through a passage 102' in valve body 204 to an outlet port. End cap 1140 defines an inlet port and inlet passage 1190. Passage 1190 communicates with the right side of summing piston 1150 through an orifice 1192. Passage 1190 also communicates with the recess 1172 defined by the summing piston through an orifice 1194. The pressure passage 104 of valve 202 is connected to a passage 104'Passage 104' is connected to an inlet port and passage 1200. Passage 1200 terminates in a check valve 1202. Piston 1150 defines a recess 1204. Assembly 1140 defines a passage 1205. When in the neutral or centered position, shown in FIG. 41, check valve 1202 and passage 1205 are aligned with recess 1204 in piston 1150.

In FIG. 41, centering spring 1138 performs the function of spring 282 of the embodiment of FIG. 6 and spool 92 also performs the function of the servo spool of the FIG. 6 embodiment.

When directional valve spool 92 is in the neutral or centered position, system pressure $P_{s1}$ is directed through passage 1190, orifice 1192 and orifice 1194. After leaving orifice 1194, fluid at $P_{s1}$ moves around recess 1172 and through passage or port 1170 into cavity 1152 where it acts on area 1154. Fluid at pressure $P_{s1}$ also passes through orifice 1192 and into cavity 1155 where it acts on areas 1157, 1300 and 1176. Areas 1157 and 1300 oppose each other. Area 1176 is the effective area on the right side of the piston as reviewed in FIG. 41. Fluid from pressure passage 104 passes through passage 1200 at pressure $P_{s2}$ and to check valve 1202. The opposite side of the check valve is connected to passage 1205 or recess 1204.

Control pressure $P_{c1}$ enters port 1124 and cavity 1122 where it acts on an area 1123 on the end of spool 92. Control pressure $P_{c2}$ enters port 1144 and into chamber 1142 where it acts on end area 1174 of piston 1150 and on ball 1160. Areas 1123, 1176, 1154 and 1174 are essentially equal. In the neutral position, pressure $P_{s1}$ acts on both sides of the summing piston 1150. Spring 1138 opposes both pressures $P_{c1}$ and $P_{c2}$ through the spring retainers.

When control pressure $P_{c1}$ is increased, initially the only forces acting on spool 92 are generated by pressure $P_{c1}$ acting on area 1123 and the force of spring 1138. When the pressure reaches a point where it overcomes the force of spring 1138, spool 92 will move to the left when viewed in FIG. 41. As long as pressure $P_{s2}$ is higher than the inlet pressure $P_{s1}$, check valve 1202 will remain closed and the pressures in cavities 1155 and 1152 on opposite sides of piston 1150 will remain equal to inlet pressure $P_{s1}$. If pressure $P_{s2}$ at port 108 is lower than the inlet pressure, fluid will flow across orifice 1192 into cavity 1155 through passage 1205, through check valve 1202 and across the land from passage 104 to port 108. Fluid enters passages 1200 and 104' and goes out to port 108. Fluid at pressure $P_{s1}$ is restricted by orifice 1192 and flow from cavity 1155 through the check valve is essentially unrestricted. As a result, the pressure in cavity 1155 will become $P_{s2}$. The pressure $P_{s2}$ acting on area 1176 is less than the pressure $P_{s1}$ acting on area 1154. Piston 1150 will be balanced against the force generated by $P_{c1}$ on spool end 1123 and maintain a leakage flow across orifice 1192 to port 108.

If the load pressure $P_{s2}$ is greater than $P_{s1}$, spool 92 continues to move to the left until the center of the spool 92 raises system pressure $P_{s1}$ higher than load pressure $P_{s2}$at port 108. At this point, flow would start across check valve 1202 and the pressure acting on area 1176 will become pressure $P_{s2}$ and the spool will be in balance. Upon an increase in the command signal pressure $P_{c1}$, spool 92 will continue to move to the left and increase the system pressure $P_{s1}$. This causes a flow rate across the load holding check valve 106 and a pressure differential $(P_{s1}-P_{s2})$ equal to the increase in pressure $P_{c1}$ over the pressure required to balance the force from spring 1138. Spool 92 will be in balance because the pressure differential $(P_{s1}-P_{s2})$ is equal to the increase in pressure $P_{c1}$ over that required to balance the force from spring 1138 and because the areas on the summing piston 1150 and the area 1123 on spool 92 are equal.

If the pressure $P_{s2}$ at port 110 is higher than inlet pressure, such is typically the result of the cylinder or motor connected to the port having an overhauling load. In such event, there will be a force on spool 92 caused by restricted flow across land 150 between port 110 and tank 96. This force will provide a feedback force to balance the increase in pressure $P_{c1}$ acting on area 1123. This causes a somewhat smaller flow rate to port 108 than would have been predicted based upon the input pressure signal $P_{c1}$.

In the event of an increase in pressure $P_{s1}$ as a result of the operation of another valve in the circuit which requires a higher pressure than that then existing at port 108, flow rate across the check valve 106 will increase. This increased flow rate increases the differential pressure fed to the summing device from passages 102, 104 thereby unbalancing spool 92 and piston 1150 will cause spool 92 to move towards center to restrict flow to outlet port 108. As a result, the valve is individually pressure compensated.

When a control pressure $P_{c2}$ is applied to port 1144, spool 92 will move to the right after the pressure $P_{c2}$ acting on area 1174 and ball 1160 overcomes the preload force of spring 1138. If pressure $P_{s2}$ is less than pressure $P_{s1}$ when piston 1150 starts moving to right, fluid from recess or cavity 1172 will be connected to passage 1205 which will open check 1202, and flow through passages 104', 104 to port 110. Fluid to recess 1172 must pass from pressure $P_{s1}$ in passage 1190 across orifice 1194. Also, there is much less restriction between recess 1172 and port 110 than between recess 1172 and passage 1190. Therefore, the pressure in cavities 1172 and 1152 will be $P_{s2}$. Fluid from passage 104 will pass to outlet port 110. System pressure $P_{s1}$ will exist in cavity 1155 on the right side of piston 1150. System pressure $P_{s2}$ will result in cavity 1152 on the left of the summing piston as a result of flow through orifice 1194, passage 1205, groove 1204 and check valve 1202 to passage 104' and out cylinder port 110. In this instance, the differential pressure acting on piston 1150 is reversed from the situation when control pressure $P_{c1}$ is applied. Ball 1160 will move within cavity 1152 of summing piston 1150. Pressure $P_{c2}$ will act on the left-hand side of piston 1150 and be applied to areas 1174 and 1154 if system pressure $P_{s1}$ is lower than the control pressure $P_{c2}$. In this instance, spool 92 will start to move at a pressure one half the level of pressure $P_{c2}$, than that which would have been required if system pressure $P_{s1}$ were equal to or greater than pressure $P_{c2}$. When the pressure $P_{s1}$ is greater than or equal to $P_{c2}$, ball 1160 will be held against plug 1162. When pressure $P_{c2}$ is greater than pressure $P_{s1}$, the valve is not pressure compensated. Another disadvantage of the single stage valve resulting when $P_{c2}$ is greater than $P_{s1}$ is that a step increase in flow to port 110 results when the valve starts to open. This is generally not a serious problem since there is no load on cylinder port 110.

The single stage embodiment illustrated in FIG. 41 still employs the pressure differential across a load holding check valve as a feedback signal which balances a command pressure force or signal. Pressure compensation is, however, less accurate than in the two stage versions. The hysteresis of the single stage valve will be greater. The flow rates from the ports 108, 110 as a function of control pressures $P_{c1}$ or $P_{c2}$ are not as predictable. The single stage design has, however, certain advantages over the two stage design including less cost and the fact that the two stage valve does not sense flow rate due to overhauling loads. Since the single stage valve senses such flow rate, the valve could control the "meter out" flow rate.

Each of the various embodiments employs a pressure differential from a load holding check valve in a directional hydraulic valve as a feedback signal. This feedback signal is balanced against the command pressure or force to control flow rates. The valves are individually pressure compensated thereby eliminating operational difficulties heretofore experienced. The pressure compensation structure and concept in accordance with the present invention are readily employed in hydraulically controlled remote systems and electrically controlled remote systems.

In view of the foregoing descriptions, those of ordinary skill in the art may envision various modifications which would not depart from the inventive concepts disclosed herein. It is expressly intended, therefore, that the above description should be considered as only that of the preferred embodiments. The true spirit and scope of the present invention may be determined by reference to the appended claims.

The embodiments of the invention in which an exclusive property or privilege is claimed are defined as follows.

1. A servo and pilot valve assembly for controlling the flow rate of fluid between an inlet passage and a pressure passage in an hydraulic valve by positioning a valve in response to first and second control input pressures, said assembly comprising:

a body defining a first control pressure input, a second control pressure input, an inlet passage, a pressure passage, a drain, a servo bore, a pilot bore and passage means for interconnecting the control pressure inputs, the servo bore, the pilot bore, the inlet passage, the pressure passage and the drain;

a servo spool movably disposed within said servo bore, said servo spool and said bore defining a command pressure chamber, a pressure passage chamber, a first control pressure chamber, a drain chamber, a second control pressure chamber and an inlet passage chamber; and a pilot piston disposed within said pilot bore and dividing the bore into first and second cylinder chambers, said pilot piston adapted to be connected to the valve, said passage means connecting said first control pressure chamber with said first cylinder chamber and said second control pressure chamber with said second cylinder chamber, said control pressure inputs with said command pressure chamber, said inlet passage with said inlet passage chamber, said pressure passage with said pressure passage chamber and wherein said passage means and said servo spool are configured and dimensioned so that said assembly compares the differential pressure between the inlet passage and the pressure passage to the pressure within said command pressure chamber to direct fluid to the pilot bore and to the drain port to position the valve spool until the differential pressure equals the command pressure.

2. An assembly as defined by claim 1 wherein the servo is an elongated generally cylindrical member having ends, a plurality of circumferential lands, a transverse passage, and end bores communicating with said transverse passage, said transverse passage opening into said drain chamber.

3. An assembly as defined by claim 1 further including:

a pilot piston spring assembly within said pilot bore for exerting a force biasing the piston to a neutral position.

4. An assembly as defined by claim 3 wherein said pilot piston spring assembly comprises:

a first retainer adapted to engage an end of the valve spool;

a second retainer engaging the piston; and a pilot spring positioned between and engaging said retainers.

5. An assembly as defined by claim 1 further including:

a pilot piston spring assembly within said pilot bore for exerting a force biasing the pilot piston to a neutral position.

6. An assembly as defined by claim 5 wherein said pilot piston spring assembly comprises:

a first retainer adapted to engage an end of the valve spool;

a second retainer engaging the pilot piston; and a pilot spring positioned between and engaging said retainers.

7. An assembly as defined by claim 1 further comprising:

a source of control fluid;

a first solenoid valve means connected to said source and said first control pressure input for selectively directing said source of control fluid to said first control pressure input.

8. An assembly as defined by claim 7 further comprises:

a second solenoid valve means connected to said source and said second control pressure input for selectively directing said source of control fluid to said second control pressure input.

9. An assembly as defined by claim 8 wherein said first and second solenoid valve means are on/off solenoid valves.

10. An assembly as defined by claim 8 wherein said first and second solenoid valve means are proportional solenoid valves.

11. A pressure compensated mobile control valve assembly comprising:

an hydraulic directional valve having an inlet port, an inlet passage, a linear flow measuring load holding check valve, an outlet passage connecting with a pair of cylinder ports, said load holding check valve having a differential pressure signal output which is directly proportional and linear to flow rate between the inlet passage and said outlet passage, said valve being positioned between said inlet passage and said outlet passage and including a seat, a valve element and spring means having a spring rate for biasing said valve element toward said seat and for controlling opening of the valve element so that the flow rate through the check valve is substantially directly proportional to the pressure in the inlet passage minus the pressure in the outlet passage and, hence, differential pressure across the check valve, said directional valve further including a tank passage connecting with a tank port and a valve spool for directing fluid from the inlet passage to the outlet passage and to one of said cylinder ports while connecting the other of said cylinder ports to the tank passage;

signal means for generating a command signal; and pressure compensating control means operatively connected to said inlet passage, said outlet passage downstream of said load holding check valve thereby receiving said differential pressure signal output and said signal means for positioning said valve spool in response to the command signal, said control means comparing said command signal to the differential pressure signal output between said inlet passage and said outlet passage across said load holding check valve to position said valve spool and compensate for pressure variations in said inlet and outlet passages and achieve a desired flow rate in said hydraulic valve to said one of said cylinder ports.

12. An assembly as defined by claim 11 wherein said control means comprises:

a body defining a pilot bore; and a pilot piston disposed within said pilot bore and defining therewith first and second cylinder chambers, said piston being connected to said valve spool.

13. An assembly as defined by claim 12 wherein said pressure compensating control means includes:

servo means operatively connected to said inlet passage, said outlet passage, said tank passage and said signal means for comparing said differential pressure to said command signal and varying the pressure within said cylinder chambers to position the valve spool until a force created by the differential pressure is approximately equal to a force created by the command signal.

14. An assembly as defined by claim 12 wherein said control means further includes:

a first retainer disposed within said pilot bore and engaging said valve spool;

a second retainer disposed within said pilot bore and engaging said pilot piston; and a spring positioned between and engaging said retainers.

15. An assembly as defined by claim 11 when said signal means comprises:

a source of control fluid under pressure;

a first regulator connected to said source and said control means for generating a first command signal and for shifting the valve spool to cause fluid flow from the inlet port to one of said cylinder ports; and a second regulator connected to said source and said control means for generating a second command signal and for shifting the valve spool to cause fluid flow from the inlet port to the other of said cylinder ports.

16. An assembly as defined by claim 15 wherein said first and second regulators are proportional solenoid valve assemblies.

17. An assembly as defined by claim 15 wherein said first and second regulators are mechanical pressure regulators.

18. An assembly as defined by claim 15 where said first and second regulators are on/off solenoid valve assemblies.

19. An assembly as defined by claim 11 wherein said signal means comprises a proportional solenoid assembly having an armature operatively connected to said pressure compensating control means.

20. An assembly as defined by claim 24 wherein signal means includes fluid regulator means for generating a first control input pressure and a second control input pressure and wherein said pressure compensating control means comprises:

a first end cap having an input port connected to said flow rate signal means at said first control input pressure, said end cap defining a bore, said valve spool having an end extending into said bore;

a spring assembly within said bore of said first end cap for exerting a force biasing the valve spool to a neutral position;

a second end cap having an input port connected to said flow rate signal means at said second control input pressure, said end cap defining a control bore, an inlet passage connectable to the inlet passage of the directional valve and pressure passage connectable to the inlet passage of the directional valve;

a summing control piston movably disposed within said control bore and connected to an opposite end of the valve spool, said control piston defining a first piston chamber, a first end area, a second piston chamber and a second end area, an elongated recess, a port between said recess and said first chamber and a circular groove;

a ball disposed within said control bore, said ball being moveable within said first piston chamber;

a ball seat extending into said first piston chamber, said end cap defining orifices connecting the pressure passage to the control bore; and a control check valve between said pressure passage and said control bore for permitting flow only from said control bore to said pressure passage, said control means applying a differential pressure across said summing control piston to create a force in opposition to a force created by one of said control input pressures which acts to shift said valve spool until the flow rate is substantially equal to a desired flow rate as set by said flow rate signal means.

21. An assembly as defined by claim 20 wherein said pressure compensating control means comprises:

a source of control fluid under pressure;

a first regulator connected to said source and said control means for generating a first command signal and for shifting the valve spool to cause fluid flow from the inlet port to one of said cylinder ports; and a second regulator connected to said source and said control means for generating a second command signal and for shifting the valve spool to cause fluid flow from the inlet port to the other of said cylinder ports.

22. A pressure compensated mobile control valve assembly comprising:

an open center, hydraulic directional valve having an inlet port, an inlet passage, a load holding check valve, an outlet passage connecting with a pair of cylinder ports, a tank passage connecting with tank ports and a valve spool for directing fluid from the inlet passage to the outlet passage and to one of said cylinder ports while connecting the other of said cylinder ports to a tank passage;

signal means for generating a command signal; and pressure compensating control means operatively connected to said inlet passage, said outlet passage downstream of said load holding check valve and said signal means for positioning said valve spool in response to the command signal, said control means comparing said command signal to the differential pressure between said inlet passage and said outlet passage to compensate for pressure variations in said inlet and outlet passages and achieve a desired flow rate in said open center hydraulic valve to said one of said cylinder ports, said pressure compensating control means comprising a body defining a pilot bore; a pilot piston disposed within said pilot bore and defining therewith first and second cylinder chambers, said piston being connected to said valve spool; and servo means operatively connected to said inlet passage, said outlet passage, said tank passage and said signal means for comparing said differential pressure to said command signal and varying the pressure within said cylinder chambers to position the valve spool until a force created by the differential pressure is approximately equal to a force created by the command signal, and wherein said servo means comprises:

said body defining a servo bore and a passage network;

a servo spool disposed within said servo bore, said servo spool and said servo bore defining a command pressure chamber, an outlet passage pressure chamber, an inlet passage pressure chamber, a drain chamber, a first control pressure chamber and a second control pressure chamber; and resilient means within said servo bore for resiliently biasing said servo spool to an initial position within said bore.

23. An assembly as defined by claim 22 wherein said servo spool defines opposed bores opening from opposite ends of said servo spool and a transverse passage which is connected to said opposed bores.

24. An assembly as defined by claim 23 wherein said servo bore defines a plurality of recesses and said servo spool includes a plurality of lands which define said chambers.

25. An assembly as defined by claim 29 wherein said command pressure chamber has an effective area equal to the effective area of said outlet passage chamber.

26. An assembly as defined by claim 25 wherein the inlet passage chamber has an effective area equal to one-half that of said command pressure chamber.

27. An assembly as defined by claim 25 wherein passage network includes restrictive orifice means for producing a pressure within the inlet passage pressure chamber which is approximately equal to one-half the pressure within said inlet passage.

28. A pressure compensated mobile control valve assembly comprising:

an open center, hydraulic directional valve having an inlet port, an inlet passage, a load holding check valve, an outlet passage connecting with a pair of cylinder ports, a tank passage connecting with tank ports and a valve spool for directing fluid from the inlet passage to the outlet passage and to one of said cylinder ports while connecting the other of said cylinder ports to a tank passage;

signal means for generating a command signal; and pressure compensating control means operatively connected to said inlet passage, said outlet passage downstream of said load holding check valve and said signal means for positioning said valve spool in response to the command signal, said control means comparing said command signal to the differential pressure between said inlet passage and said outlet passage to compensate for pressure variations in said inlet and outlet passages and achieve a desired flow rate in said open center hydraulic valve to said one of said cylinder ports, said control means comprising:

a body defining a pilot bore;

a pilot piston disposed within said pilot bore and defining therewith first and second cylinder chambers, said piston being connected to said valve spool;

a first retainer disposed within said pilot bore and engaging said valve spool;

a second retainer disposed within said pilot bore and engaging said pilot piston; and a spring positioned between and engaging said retainers, and wherein said pressure compensating control means further includes:

servo means operatively connected to said inlet passage, said outlet passage, said tank passage and said signal means for comparing said differential pressure to said command signal and varying the pressure within said cylinder chambers to position the valve spool until a force created by the differential pressure is approximately equal to a force created by the command signal, said servo means comprising:

said body defining a servo bore and a passage network;

a servo spool disposed within said servo bore, said servo spool and said servo bore defining a command pressure chamber, an outlet passage pressure chamber, an inlet passage pressure chamber, a drain chamber, a first control pressure chamber and a second control pressure chamber; and resilient means within said servo bore for resiliently biasing said servo spool to an initial position within said bore.

29. An assembly as defined by claim 28 wherein said servo bore defines a plurality of recesses and said servo spool includes a plurality of lands which define said chambers.

30. An assembly as defined by claim 29 wherein said command pressure chamber has an effective area equal to the effective area of said outlet passage chamber.

31. An assembly as defined by claim 30 wherein the inlet passage chamber has an effective area equal to one-half that of said command pressure chamber.

32. An assembly as defined by claim 31 wherein passage network includes restrictive orifice means for providing a pressure within the inlet passage pressure chamber which is approximately equal to one-half the pressure within said inlet passage.

33. A pressure compensated mobile control valve assembly comprising:

a plurality of open center, hydraulic directional valves, each valve having a common inlet port, a common inlet passage, a load holding check valve assembly including a seat downstream of the inlet passage, a valve element and a means for biasing the valve element towards said seat and for generating a differential pressure signal which is substantially linear with flow, said inlet passage directing fluid to each of said check valve assemblies, an outlet passage downstream of the check valve assembly connecting with a pair of cylinder ports, a tank passage connecting with tank ports and a valve spool for directing fluid from the inlet passage to the outlet passage and to one of said cylinder ports while connecting the other of said cylinder ports to the tank passage;

a plurality of signal means each connected to one of said directional valves for generating a command signal each of said signal means including a first control pressure input passage, a second control pressure input passage, a command pressure passage connected to said control pressure input passages, a source of control fluid and means for selectively directing said control fluid to either of said control pressure input passages; and a plurality of pressure compensating control means each operatively connected to said common inlet passage, said common outlet passage downstream of one of said load holding check valves, one of said directional valves and one of said signal means for positioning said valve spool in response to the command signal, said control means directly receiving a command signal from one of said control pressure input passages and comparing said command signal to the differential pressure between said inlet passage and said outlet passage, and controlling a valve spool positioning pressure applied to the valve spool of one of said directional valves to position the valve spool to compensate for pressure variations in said inlet and outlet passages and achieve a desired flow rate in said open center hydraulic valve to said one of said cylinder ports.

34. An assembly as defined by claim 33 wherein each of said control means comprises:

a body defining a pilot bore; and a pilot piston disposed within said pilot bore and defining therewith first and second cylinder chambers, said piston being connected to said valve spool.

35. An assembly as defined by claim 34 wherein each of said pressure compensating control means includes:

servo means operatively connected to said inlet passage, said outlet passage, said tank passage and said signal means for comparing said differential pressure to said command signal and varying the pressure within said cylinder chambers to position the valve spool until a force created by the differential pressure is approximately equal to a force created by the command signal.

36. An assembly as defined by claim 55 wherein each of said servo means comprises:

said body defining a servo bore and a passage network;

a servo spool disposed within said servo bore, said servo spool and said servo bore defining a command pressure chamber, an outlet passage pressure chamber, an inlet passage pressure chamber, a drain chamber, a first control pressure chamber connected to said first control pressure input passage and a second control pressure chamber connected to said second control pressure input passage; and resilient means within said servo bore for resiliently biasing said servo spool to an initial position within said bore.

37. An assembly as defined by claim 33 wherein said means for selectively directing said control fluid comprises:

a first solenoid valve means connected to said source and said first control pressure input passage for selectively directing said source of control fluid to said first control pressure input passage; and a second solenoid valve means connected to said source and said second control pressure input passage for selectively directing said source of control fluid to said second control pressure input passage.

38. An assembly as defined by claim 23 wherein said first and second solenoid valve means are on/off solenoid valves.

39. An assembly as defined in claim 37 wherein said first and second solenoid valve means are proportional solenoid valves.

* * * * *

UNITED STATES PATENT AND TRADEMARK OFFICE

CERTIFICATE OF CORRECTION

PATENT NO. : 5,056,561

DATED : October 15, 1991

INVENTOR(S) : James O. Byers

It is certified that error appears in the above-identified patent and that said Letters Patent is hereby corrected as shown below:

Column 7, line 27;
After "above" insert --.--.
Column 10, line 23;
After "spools" insert --.--.
Column 10, line 48
After "parallel" insert --.--.
Column 10, line 53;
After "device" insert --.--.
Column 11, line 44;
After "level" insert --.--.
Column 17, line 46;
"o" should be --or--.
Column 22, claim 20, line 62;
"24" should be --11--.
Column 24, claim 25, line 34;
"29" should be --24--.
Column 26, claim 36, line 36;
"55" should be --35--.
Column 26, claim 38, line 62;
"23" should be --37--.

Signed and Sealed this

Eighth Day of June, 1993

*Attest:*

Michael K. Kirk

MICHAEL K. KIRK

*Attesting Officer*

*Acting Commissioner of Patents and Trademarks*